US005432051A

United States Patent [19]

Kashi

[11] Patent Number: 5,432,051

[45] Date of Patent: Jul. 11, 1995

[54] SILVER HALIDE COLOR PHOTOGRAPHIC MATERIAL

[75] Inventor: Yasuo Kashi, Kanagawa, Japan

[73] Assignee: Fuji Photo Film Co., Ltd., Kanagawa, Japan

[21] Appl. No.: 212,389

[22] Filed: Mar. 14, 1994

Related U.S. Application Data

[63] Continuation of Ser. No. 868,870, Apr. 16, 1992, abandoned.

[30] Foreign Application Priority Data

Apr. 18, 1991 [JP] Japan ..... 3-112259

[51] Int. Cl.[6] ..... G03C 1/09

[52] U.S. Cl. ..... 430/567; 430/570; 430/599; 430/611; 430/614

[58] Field of Search ..... 430/567, 569, 570, 599, 430/611, 614

[56] References Cited

U.S. PATENT DOCUMENTS 4,748,106 5/1988 Hayashi ..... 430/567
4,783,398 11/1988 Takada et al. ..... 430/569
4,952,491 8/1990 Nishikawa et al. ..... 430/569
5,059,517 10/1991 Ihama et al. ..... 430/567

FOREIGN PATENT DOCUMENTS 0326853 8/1989 European Pat. Off. .
0421741 4/1991 European Pat. Off. .

OTHER PUBLICATIONS

Research Disclosure 308119, Dec. 1989, pp. 993–1000.

*Primary Examiner*—Janet C. Baxter
*Attorney, Agent, or Firm*—Sughrue, Mion, Zinn, Macpeak & Seas

[57] ABSTRACT

A silver halide color photographic material is disclosed having on a support at least one light-sensitive silver halide emulsion layer comprising a chemically sensitized tabular silver halide emulsion containing tabular silver halide grains having an average diameter of 0.6 μm or less and an average aspect ratio of from 2.0 to 5.0. The tabular silver halide emulsion is chemically sensitized in the presence of at least one spectral sensitizing dye, to provide a high sensitivity/granularity ratio, improved sharpness and stress resistance, and high production stability.

8 Claims, No Drawings

SILVER HALIDE COLOR PHOTOGRAPHIC MATERIAL

This is a continuation of application Ser. No. 07/868,870 filed Apr. 16, 1992 now abandoned.

FIELD OF THE INVENTION

The present invention relates to a silver halide color photographic material which has an excellent sensitivity/granularity ratio, improved sharpness and stress resistance, and high production stability.

BACKGROUND OF THE INVENTION

Recent technological investigations in the field of silver halide color photographic materials largely concern development of photographic materials having high photographic speed, as represented by photograph-taking films of ISO 1600, which photographic materials can provide satisfactory graininess, sharpness and color reproducibility even when used for picture taking with a camera of small format, such as a 110-size system or disk-size system, or which film is fitted with a lens, such as "Utsurundesu Hi" or "Utsurundesu Panoramic", trade name, products of Fuji Photo Film Co., Ltd. Namely, there is a demand for a much higher level of individual photographic characteristics.

In response to these demands, the use of tabular grains has been investigated to provide improvements in sensitivity, including enhancement of color sensitization efficiency by the use of sensitizing dyes, sensitivity-granularity relationship, sharpness and covering power as disclosed in U.S. Pat. Nos. 4,434,225, 4,414,310, 4,433,048, 4,414,306 and 4,459,353, JP-A-58-113927, JP-A-59-119350, etc. (The term "JP-A" as used herein means an "unexamined published Japanese patent application").

Furthermore, methods of using tabular grains having relatively small sizes (diameter of grains: 0.6 μm or less) are disclosed in U.S. Pat. Nos. 4,439,520, 4,435,499 and 4,748,106, JP-A-62-99751, etc.

Tabular grains described in those specifications have an average aspect ratio of 5 or more, or 8 or more. The use of such tabular grains is effective in reducing the light scattering phenomenon caused by silver halide grains in the emulsion layers of a sensitive material, which phenomenon is considered mainly responsible for deterioration of sharpness. However, grains having a high aspect ratio are often inferior in stress resistance, such that it was difficult to increase sharpness to a satisfactory extent without deterioration of stress resistance.

In addition, since tabular grains having a high aspect ratio are fine and extremely thin, such grains tend to become deformed, for example, by perforating, under influence of the pAg of the emulsion containing these grains, and by being subjected to reagents which dissolve silver halides, etc. Therefore, it has hitherto been difficult to stably produce a silver halide photographic material containing such a tabular emulsion.

SUMMARY OF THE INVENTION

A first object of the present invention is to provide a silver halide photographic material having excellent granularity, improved sharpness and stress resistance, as well as high sensitivity.

Another object of the present invention is to stably prepare a silver halide color photographic material which satisfies the above-noted objective.

The objects of the present invention are attained with a silver halide color photographic material comprising a support having thereon at least one light-sensitive silver halide emulsion layer comprising a chemically sensitized silver halide emulsion containing silver halide grains having an average diameter of 0.6 μm or less and an average aspect ratio of from 2.0 to 5.0, said tabular silver halide emulsion is prepared by:

reacting a water-soluble silver salt and a water-soluble alkali halide in an aqueous reaction system containing gelatin to form a tabular silver halide emulsion containing tabular silver halide grains;

desalting; and subjecting the desalted emulsion to chemical sensitization in the presence of at least one spectral sensitizing dye.

DETAILED DESCRIPTION OF THE INVENTION

The preparation process of a silver halide emulsion is generally divided into grain formation, desalting, chemical sensitization and coating steps. The grain formation step is further divided into nucleation, ripening, growth and other stages. Those steps are not always carried out in the same order as described above. In certain circumstances, a part of the order may be reversed, or some of the steps may be repeatedly carried out depending on the intended application.

The tabular silver halide grains contained in the silver halide color photographic material of the present invention are described in detail below.

The term "tabular grains" as used herein is a general designation for grains having one twin plane or not less than two parallel twin planes. The twin plane is defined as the (111) plane, wherein all lattice ions on both sides of the (111) plane have a mirror image relationship.

The term "aspect ratio" used herein in describing a tabular-grain silver halide emulsion signifies the ratio of diameter of each silver halide grain to the thickness thereof. In other words, the aspect ratio is the value obtained by dividing the diameter of each silver halide grain by the thickness thereof. The term "diameter" as used herein refers to the diameter of a circle having the same area as the projected area of each grain, as determined by observation under a microscope or an electron microscope. Accordingly, an aspect ratio of 3 or more means that the diameter of the corresponding circle is no less than three times the thickness thereof.

Furthermore, the average aspect ratio is determined as follows: 1,000 grains are randomly selected from all of the grains contained in the silver halide emulsion, and the aspect ratio of each grain is measured. Tabular grains in a number corresponding to 50% of the total projected area of the selected grains are grouped in order of those having the larger aspect ratios, and the arithmetic mean of the individual aspect ratios of the group of tabular grains having the larger aspect ratios is calculated. The thus obtained value is defined as average aspect ratio. Similarly the arithmetic means of individual diameters and individual thicknesses of the group of tabular grains used in determining the average aspect ratio are taken as the average diameter and average thickness, respectively.

An example of a method for determining the aspect ratios involves taking photomicrographs of emulsion grains using a replica process and a transmission electron microscope, to thereby find the circle equivalent diameter and the thickness of each grain. In this case, the thickness is calculated from the length of the shadow of the replica.

The tabular silver halide grains of the present invention have an average aspect ratio ranging from 2.0 to 5.0, preferably from 3.0 to 4.8, and particularly preferably from 4.0 to 4.6. The average diameter is less than 0.6 μm, preferably in the range of 0.15 to 0.5 μm, particularly preferably in the range of 0.2 to 0.4 μm.

The proportion of tabular silver halide grains of the present invention to all of the silver halide grains contained in the same emulsion layer is at least about 50%, preferably at least about 70%, and particularly preferably at least about 85%, on a projected area basis.

A silver halide photographic material prepared using the above described emulsion of the present invention can provide excellent sharpness. The excellent sharpness is attributable to reduced light scattering, in contrast to that obtained from a conventional emulsion layer. This result is readily confirmed by routine measurements know to those of ordinary skill in the art. Although the precise reason for reduced light scattering from the emulsion layer comprising the tabular-grain silver halide emulsion is not fully understood, it is considered a result of the parallel orientation of the main faces of the tabular silver halide grains to the support surface.

The silver halide constituting the tabular emulsion grains may include any of silver bromide, silver iodobromide, silver chloride, silver chlorobromide, silver iodochlorobromide and silver iodochloride.

The tabular silver halide grains of the present invention may have a layer structure comprising at least two layers substantially differing in halogen composition, or may have a uniform halogen composition throughout the entire grain.

A grain size distribution of the tabular silver halide according to the present invention is not limited in either narrow or broad range, however, single dispersible grains are preferably used.

The tabular silver halide grains may comprise any type of silver salts, such as bromide, iodobromide, chloride, chlorobromide, iodochlorobromide, and iodochloride. The halide composition in a total tabular silver halide grains preferably occupies in exceeding 5 mol %, more preferably 5.5 to 20 mol % and further preferably 6 to 14 mol %.

In a preferred embodiment, the tabular silver halide grains of the present invention have an average silver iodide content of 5 mol % or more.

The emulsion grains having a layer structure may contain a layer having a high iodide content as the core part and a layer having a low iodide content as the outermost layer, or may have a low iodide content in the core part and a layer having a high iodide content as the outermost layer. Also, the layer structure may comprise three or more layers, wherein the iodide content in each layer is progressively lower towards the outer surface of the grain.

Of these layer structures, the tabular silver halide grains having high iodide containing layer in a core part and low iodide containing layer in a shell part show remarkably excellent advantages according to the present invention.

The chemically sensitized tabular grain silver halide emulsion of the present invention can be obtained based on known methods for preparation of tabular grain silver halide emulsions. Although methods of preparing tabular grain silver halide emulsions are described, e.g., Duffin, *Photographic Emulsion Chemistry,* pages 66–72, Focal press, New York (1966); and P. H. Trivelli & W. F. Smith, *Phot. Journal,* volume 80, page 285 (1940), such emulsions can be readily prepared by reference to the methods disclosed in JP-A-58-113927, JP-A-58-113928 and JP-A-58-127921.

In addition, the methods described, e.g., in Cleve, *Photography: Theory and Practice,* page 131 (1930); Gutoff, *Photographic Science and Engineering,* volume 14, pages 248–257 (1970); U.S. Pat. Nos. 4,434,226, 4,414,310, 4,433,048 and 4,439,520; and British Patent 2,112,157 can ensure simple preparation of tabular-grain silver halide emulsions.

For example, seed crystals no less than 40 wt % of which are tabular grains are formed in an environment having a pBr of 1.3 or less and a relatively high pAg, and thereto is added simultaneously a soluble silver salt and halide solutions while the pBr is maintained at about the above value. In the course of the grain growth, it is desirable that soluble silver salt and halide solutions are further added to prevent new nucleation.

In the tabular-grain silver halide emulsion of the present invention, the sizes of the tabular grains can be controlled by properly selecting the temperature and the type and the volume of silver halide solvents introduced to the reaction system, and by controlling the addition rate of the soluble silver salt and halide solutions during grain formation.

In preparing the emulsion of the present invention, the step of chemical sensitization (chemical ripening) must include subjecting the emulsion grains to chemical sensitization in the presence of a spectral sensitizing dye by the conclusion of chemical ripening. The case of terminating the chemical sensitization with the addition of a spectral sensitizing dye is also included within the scope of the present invention (i.e., chemical sensitization in the presence of at least one spectral sensitizing dye). Sensitizing dyes are added in the present invention to control crystal growth at the time of grain formation, or to control photosensitive nucleation in chemical sensitization. As a consequence of the addition of a spectral sensitizing dye in the above-described manner, the dyes are adsorbed onto the grains at a temperature higher than about 40° C. Therefore, the above-described manner of addition manner also serves to strengthen and promote the adsorption. Adsorption of the sensitizing dyes onto the tabular silver halide grains prevents deformation, such that silver halide photographic materials comprising the tabular emulsion of the present invention can be stably prepared.

The expression "conclusion of chemical ripening" as employed herin refers to the period between a time for starting of descending temperature, thereby terminating the progress of the chemical sensitization, to a time at which the temperature is descended by 10° C.

The chemical sensitization in the presence of a spectral sensitizing dye can be carried out at any stage of the emulsion-making process known to be useful four preparing emulsions as long as that stage is prior to the completion of chemical ripening. As U.S. Pat. Nos. 3,628,960 and 4,225,666 teach, spectral sensitization can be carried out at the same time as or prior to chemical sensitization, or can commence before the conclusion of precipitation of the silver halide grains. On the other hand, as U.S. Pat. No. 4,225,666 teaches, a portion of a spectral sensitizing dye may be present at a stage preceding the completion of chemical sensitization, while the remaining portion is introduced after chemical sensitization.

Namely, a spectral sensitizing dye can be added at a stage of the emulsion-making process including before or during grain formation, during physical ripening and before washing, or prior to, during and just before conclusion of chemical sensitization. However, the spectral sensitizing dye is preferably added during physical ripening, before washing or before chemical sensitization.

Spectral sensitizing dyes for use in the present invention can be used in combination with the nitrogen-containing heterocyclic compounds disclosed in JP-A-62-89952, which are represented by the following general formula:

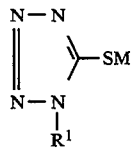

wherein $R^1$ represents an aliphatic, aromatic or heterocyclic residue substituted by at least one —COOM or —$SO_3M$ group (wherein M represents a hydrogen atom, an alkali metal atom, or a quaternary ammonium or phosphonium).

Examples of the aliphatic group represented by $R^1$ include specifically $C_{1-20}$ straight or branched chain alkyl group, such as methyl, propyl, hexyl, dodecyl, and iso-propyl group, $C_{1-20}$ cycloalkyl group, such as cyclopropyl, and cyclohexyl group.

Also examples of the aromatic group include $C_{6-20}$ aryl group such as phenyl and naphthyl group, and examples of heterocyclic group, include 5-, 6- or 7-membered hetero-ring which contains at least one of nitrogen, oxygen or sulphur atom, such as morpholino, piperidyno, and pyridine group, and those forms condensed ring at appropriate position, such as quinoline, pyrimidyne and iso-quinoline ring.

Suitable examples of the above described heterocyclic compound are illustrated below. However, the invention should not be construed as being limited to these specific examples.

M-1

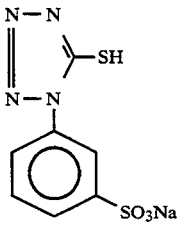

M-2

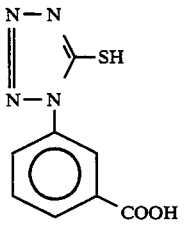

-continued

M-3

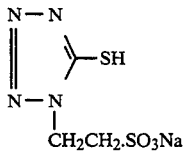

M-4

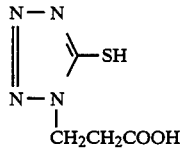

M-5

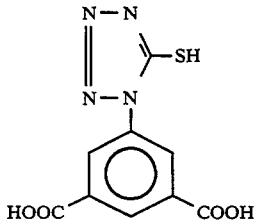

M-6

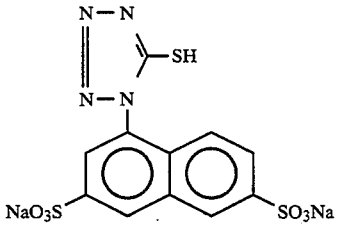

The heterocyclic compound is used in an amount of $1\times10^{-5}$ to $1\times10^{-2}$ mole, preferably $1\times10^{-4}$ to $1\times10^{-2}$ mole, per mole of silver halide.

Spectral sensitizing dyes for use in the present invention are not particularly limited, and may be selected from among conventional methine dyes.

Specifically, useful spectral sensitizing dyes include polymethine dyes such as cyanine dyes, merocyanine dyes, complex cyanine and complex merocyanine dyes (i.e., trinuclear, tetranuclear and polynuclear cyanine and merocyanine dyes), oxonol dyes, hemioxonol dyes, styryl dyes, merostyryl dyes and streptocyanine dyes.

Spectral sensitizing dyes of cyanine type contain two basic heterocyclic nuclei connected to each other via a methine linkage, which are derived from quaternary salts such as quinolinium, pyridinium, isoquinolinium, 3H-indolium, benz[e]indolium, oxazolium, oxazolinium, thiazolium, thiazolinium, selenazolium, selenazolinium, imidazolium, imidazolinium, benzothiazolium, benzothiazolinium, benzoselenazolium, benzoselenazolinium, benzimidazolium, naphthoxazolium, naphthothiazolium, naphthoselenazolium, thiazolinium, dihydronaphthothiazolium, and imidazopyradinium.

Spectral sensitizing dyes of merocyanine type include those containing an acidic nucleus derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexan-1,3-dione, 1,3-dioxan-4,6-dione, pyrazolin-3,5-dione, pentan-2,4-dione, alkylsulfonylacetonitrile, malononitrile, isoquinolin-4-one or chroman-2,4-dione, and one of the above noted cyanine dye type basic heterocyclic nuclei combined with each other via a methine linkage.

Typical examples of these dyes include methine dyes represented by the following general formulae Sens-I, Sens-II and Sens-III:

Sens-I

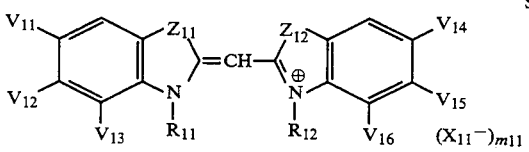

In the above formula, $Z_{11}$ represents an oxygen atom, a sulfur atom or a selenium atom, and $Z_{12}$ represents a sulfur atom or a selenium atom. $R_{11}$ and $R_{12}$ each represents a unsubstituted or substituted $C_{1-6}$ alkyl or alkenyl group, with the proviso that at least one of $R_{11}$ and $R_{12}$ is a sulfo-substituted alkyl group. In particular, it is desirable that at least either of $R_{11}$ and $R_{12}$ is a 3-sulfopropyl, 2-hydroxy-3-sulfopropyl, 3-sulfobutyl or sulfoethyl group. Suitable examples of substituent groups for $R_{11}$ and $R_{12}$ include a $C_{1-4}$ alkoxy group, a halogen atom, a hydroxy group, a carbamoyl group, an optionally substituted $C_{6-8}$ phenyl groups, a carboxyl group, a sulfo group and a $C_{2-5}$ alkoxycarbonyl group. Specific examples of groups represented by $R_{11}$ and $R_{12}$ include methyl, ethyl, propyl, allyl, pentyl, hexyl, methoxyethyl, ethoxyethyl, phenetyl, 2-p-tolylethyl, 2-p-sulfophenetyl, 2,2,2-trifluoroethyl, 2,2,3,3-tetrafluoropropyl, carbamoylethyl, hydroxyethyl, 2-(2-hydroxyethyl-)ethyl, carboxymethyl, carboxyethyl, ethoxycarbonylmethyl, 2-sulfoethyl, 2-chloro-3-sulfopropyl, 2-sulfopropyl, 2-hydroxy-3-sulfopropyl, 3-sulfobutyl and 4-sulfobutyl.

When $Z_{11}$ represents an oxygen atom, $V_{11}$ and $V_{13}$ each represents a hydrogen atom, and $V_{12}$ represents a phenyl group which may be substituted by one or more chlorine atoms, a $C_{1-3}$ alkyl group or a $C_{1-3}$ alkoxy group (particularly preferably a phenyl group). Also, $V_{11}$ and $V_{12}$, or $V_{12}$ and $V_{13}$ may combine with each other to form a condensed benzene ring. In the most preferred sensitizing dyes represented by Sens-I, $V_{11}$ and $V_{13}$ are both hydrogen and $V_{12}$ is unsubstituted phenyl.

When $Z_{11}$ represents a sulfur or selenium atom, $V_{11}$ represents a $C_{1-4}$ alkyl group, a $C_{1-4}$ alkoxy group or a hydrogen atom, $V_{12}$ represents a $C_{1-5}$ alkyl group, $C_{1-4}$ alkoxy group, a chlorine atom, a hydrogen atom, an optionally substituted phenyl group (e.g., tolyl, anisyl, phenyl) or a hydroxy group, and $V_{13}$ represents a hydrogen atom. In addition, $V_{11}$ and $V_{12}$, or $V_{12}$ and $V_{13}$ can combine with each other to form a condensed benzene ring. The case in which $V_{11}$ and $V_{13}$ are both a hydrogen atom and $V_{12}$ is an $C_{1-4}$ alkoxy group, a phenyl group or a chlorine atom, the case in which $V_{11}$ is a $C_{1-4}$ alkoxy or alkyl group and $V_{12}$ is a $C_{1-4}$ alkoxy group or hydroxy group, and the case in which $V_{12}$ and $V_{13}$ combine with each other to form a condensed benzene ring are more desirable.

When $Z_{12}$ represents a selenium atom, $V_{14}$, $V_{15}$ and $V_{16}$ have the same meanings as those represented by $V_{11}$, $V_{12}$ and $V_{13}$ respectively when $Z_{11}$ is a selenium atom. When $Z_{12}$ represents a sulfur atom and $Z_{11}$ represents a selenium atom, $V_{14}$ represents a hydrogen atom, a $C_{1-4}$ alkoxy group or a $C_{1-5}$ alkyl group, $V_{15}$ represents a $C_{1-4}$ alkoxy group, an optionally substituted phenyl group (e.g., phenyl, tolyl and anisyl, preferably phenyl), a $C_{1-4}$ alkyl group, a chlorine atom or a hydroxy group, and $V_{16}$ represents a hydrogen atom. Also, $V_{14}$ and $V_{15}$, or $V_{15}$ and $V_{16}$ can combine with each other to form a condensed benzene ring. The case in which $V_{14}$ and $V_{16}$ are both hydrogen and $V_{15}$ is a $C_{1-4}$ alkoxy group, a chlorine atom or phenyl group, and the case in which $V_{15}$ and $V_{16}$ combine with each other to form a condensed benzene ring are more preferred.

$X^-_{11}$ represents an acid anion, such as $Cl^\ominus$, $Br^\ominus$, $CH_3SO_3^\ominus$ and

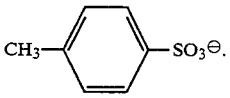

$m_{11}$ represents 0 or 1. The case of $m_{11}=0$ corresponds to dyes which assume the form of an inner salt.

Sens-II

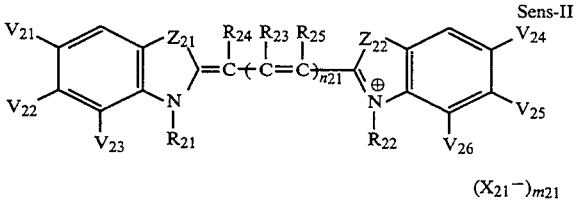

In the above formula, $Z_{21}$ and $Z_{22}$ may be the same or different, and each represents an oxygen atom, a sulfur atom, a selenium atom or $=N-R_{26}$.

$R_{21}$ and $R_{22}$ have the same meanings as $R_{11}$ and $R_{12}$ in the formula Sens-I, respectively. Further, $R_{21}$ and $R_{22}$ can combine with $R_{24}$ and $R_{25}$ respectively to form a 5- or 6-membered carbon ring. However, when $n_{21}$ represents 2 or 3, both of $R_{21}$ and $R_{22}$ can not represent a sulfo-substituted group.

$R_{23}$ represents a hydrogen atom when at least one of $Z_{21}$ and $Z_{22}$ represents $=N-R_{26}$, while $R_{23}$ represents a lower alkyl group or a phenethyl group (preferably ethyl) in other cases. Further, when $n_{21}$ is 2 or 3, $R_{23}$ and another $R_{23}$ can combine with each other to form a 5- or 6-membered ring.

$R_{24}$ and $R_{25}$ represent a hydrogen atom.

$R_{26}$ has the same meaning as $R_{21}$ or $R_{22}$. However, not both of $R_{21}$ and $R_{26}$ can not represent a sulfo-substituted group, and both of $R_{22}$ and $R_{26}$ can not represent a sulfo-substituted group.

$V_{21}$ and $V_{23}$ represents a hydrogen atom when $Z_{21}$ represents an oxygen atom, while $V_{21}$ represents a hydrogen atom, a $C_{1-5}$ alkyl group or a $C_{1-5}$ alkoxy group when $Z_{21}$ represents a sulfur or selenium atom. Further, $V_{21}$ represents a hydrogen or chlorine atom when $Z_{21}$ represents $=N-R_{26}$.

As for $V_{22}$, in addition to representing a hydrogen atom, a $C_{1-5}$ alkyl group, a $C_{1-5}$ alkoxy group, a chlorine atom or an optionally substituted phenyl group (e.g., tolyl, anisyl, phenyl), $V_{22}$ can combine with $V_{21}$ or $V_{23}$ to form a condensed benzene ring when $Z_{21}$ represents an oxygen atom and $Z_{22}$ represents $=N-R_{26}$. In a preferred case, $V_{22}$ represents an alkoxy group or phenyl group, or $V_{22}$ combines with $V_{21}$ or $V_{23}$ to form a condensed benzene ring. When both $Z_{21}$ and $Z_{22}$ represent an oxygen atom, $V_{22}$ represents an optionally substituted phenyl group (e.g., tolyl, anisyl or phenyl, preferably phenyl), or $V_{22}$ combines with $V_{21}$ or $V_{23}$ to form a condensed benzene ring. When $Z_{21}$ represents a sulfur or selenium atom, $V_{22}$ represents a hydrogen atom, a $C_{1-5}$ alkyl group, a $C_{1-5}$ alkoxycarbonyl group, a $C_{1-4}$ alkoxy group, a $C_{1-4}$ acylamino group, a chlorine atom or an optionally substituted phenyl group (more preferably a $C_{1-4}$ alkyl, a $C_{1-4}$ alkoxy, chlorine or phenyl), or $V_{22}$ can combine with $V_{23}$ to form a condensed benzene ring. When $Z_{21}$ represents $=N—R_{26}$, $V_{22}$ represents a chlorine atom, a trifluoromethyl group, a cyano group, a $C_{1-4}$ alkylsulfonyl group or a $C_{1-5}$ alkoxycarbonyl group. In the case of $Z_{21}==N—R_{26}$, $V_{21}$ is more preferably chlorine, and $V_{22}$ is chlorine, trifluoromethyl or cyano.

$V_{24}$ has the same meaning as $V_{21}$ for $Z_{22}$ corresponding to the same atom or the group represented by $Z_{21}$.

As for $V_{25}$ in the case of $Z_{22}$ is oxygen, $V_{25}$ represents a $C_{1-4}$ alkoxy group, a chlorine atom or an optionally substituted phenyl group (e.g., anisyl, tolyl, phenyl ), or $V_{25}$ can combine with $V_{24}$ or $V_{26}$ to complete a condensed benzene ring. More preferably, $V_{25}$ represents a $C_{1-4}$ alkoxy group or phenyl group, or $V_{25}$ combines with $V_{24}$ or $V_{26}$ to form a condensed benzene ring in the case of $Z_{21}$ is $=N—R_{26}$, while $V_{25}$ represents phenyl group or can combine with $V_{24}$ or $V_{26}$ to form a condensed benzene ring in the case of $Z_{21}=O$, S or Se atom. $V_{25}$ in the case of $Z_{22}$ is $=N—R_{26}$ has the same meaning as $V_{22}$ in the case of $Z_{21}$ is $=N—R_{26}$, while $V_{25}$ in the case of $Z_{22}$=sulfur or selenium atom has the same meaning as $V_{22}$ in the case of $Z_{21}$ is $=N—R_{26}$.

$V_{26}$ represents a hydrogen atom.

$X^-_{21}$ represents an acid anion.

$m_{21}$ represents 0 of 1. The case of $m_{21}$ is 0 corresponds to dyes which assume the form of an inner salt.

$n_{21}$ represents 1, 2 or 3.

Sens-III

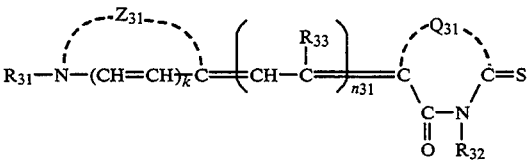

In the above formula, $Z_{31}$ represents a group of atoms forming an optionally substituted thiazoline, thiazole, benzothiazole, naphthothiazole, selenazoline, selenazole, benzoselenazole, naphthoselenazole, benzimidazole, naphthoimidazole, oxazole, benzoxazole, naphthoxazole or pyridine nucleus. In the case where $Z_{31}$ forms a benzimidazole or naphthoimidazole nucleus, a substituent group, which is different from $R_{31}$, attached to the nitrogen situated at the 1-position can include those represented by $R_{26}$ in Sens-II. As for the substituent group(s) for the condensed benzene ring, chlorine atom, cyano group, a $C_{1-5}$ alkoxycarbonyl group, a $C_{1-4}$ alkylsulfonyl group and a trifluoromethyl group can be given as examples. In a particularly preferred case, the condensed benzene ring is substituted by chlorine at the 5-position and by cyano, chlorine or trifluoromethyl at the 6-position. Heterocyclic nuclei, other than benzimidazole, selenazoline and thiazoline nuclei, can contain as substituent group(s) a $C_{1-8}$ alkyl group which may be further substituted (the substituents for the substiuted $C_{1-8}$ alkyl group including e.g., hydroxyl, chlorine, fluorine, an alkoxy, carboxyl, an alkoxycarbonyl, phenyl, a substituted phenyl), a hydroxyl group, a $C_{1-5}$ alkoxycarbonyl group, a halogen atom, carboxyl group, a furyl group, a thienyl group, a pyridyl group, phenyl group, a substituted phenyl group (e.g., tolyl, anisyl, chlorophenyl), etc. Substituent group(s) for the selenazoline and thiazoline nuclei include a $C_{1-6}$ alkyl group, a $C_{1-5}$ hydroxyalkyl group, a $C_{1-5}$ alkoxycarbonylalkyl group, etc.

$R_{31}$ has the same meaning as $R_{11}$ or $R_{12}$ in Sens-I.

$R_{32}$ not only has the same meaning as $R_{11}$ or $R_{12}$ in Sens-I, but can also represent a hydrogen atom, a furfuryl group, or an optionally substituted monocyclic aryl group (e.g., phenyl, tolyl, anisyl, carboxyphenyl, hydroxyphenyl, chlorophenyl, sulfophenyl, pyridyl, 5-methyl-2-pyridyl, 5-chloro-2-pyridyl, thiethyl, furyl). However, it is essential for Sens-III that at least one of $R_{31}$ or $R_{32}$ is a group containing a sulfo or carboxyl group, and the other is a group not containing a sulfo group.

$R_{33}$ represents a hydrogen atom, a $C_{1-5}$ alkyl group, a phenethyl group, a phenyl group or 2 -carboxyphenyl group. In addition, the $R_{33}$ groups in the case of $n_{33}$ is 2 or 3 can combine with each other to form a 5- or 6-membered ring.

$Q_{31}$ represents an oxygen atom, a sulfur atom, a selenium atom, or $=N—R_{34}$. In the case of $Z_{31}$ is atoms completing a thiazoline, selenazoline or oxazole nucleus, $Q_{31}$ is preferably a sulfur atom, a selenium atom or $=N—R_{34}$.

$R_{34}$ represents a hydrogen atom, a pyridyl group, a phenyl group, a substituted phenyl group (e.g., tolyl, anisyl), or a $C_{1-8}$ aliphatic hydrocarbon residue which may contain in its carbon chain an oxygen atom, a sulfur atom or a nitrogen atom and may have a substituent group such as a hydroxyl group, a halogen atom, an alkylaminocarbonyl group, an alkoxycarbonyl group, a phenyl group, etc. More preferably, $R_{34}$ represents a hydrogen atom, a phenyl group, a pyridyl group or an alkyl group which may contain an oxygen atom in its carbon chain and may be substituted by a hydroxyl group.

k represents 0 or 1, and $n_{31}$ represents 0, 1, 2 or 3.

Specific examples of useful spectral sensitizing dyes are illustrated below.

S-1

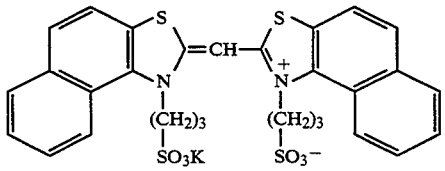

S-2

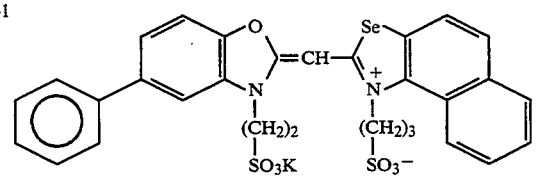

S-3

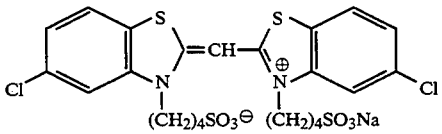

-continued
S-4
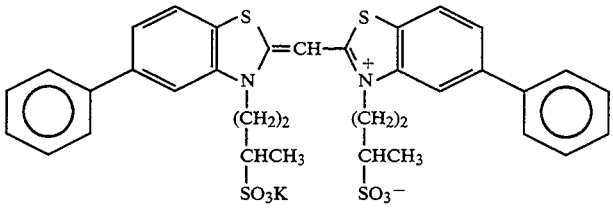
S-5
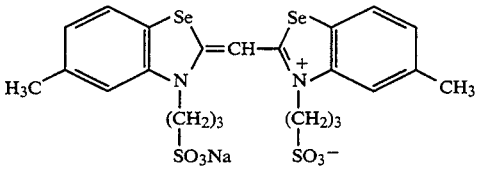
S-6
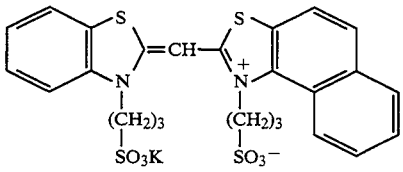
S-7
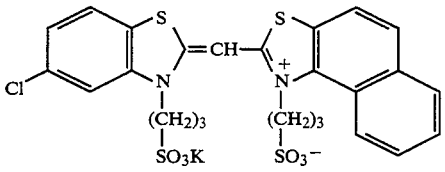
S-8
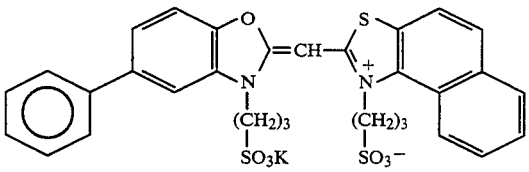
S-9
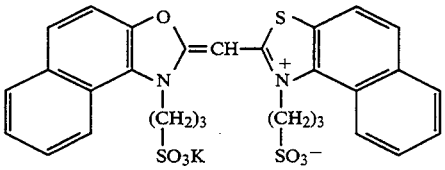
S-10
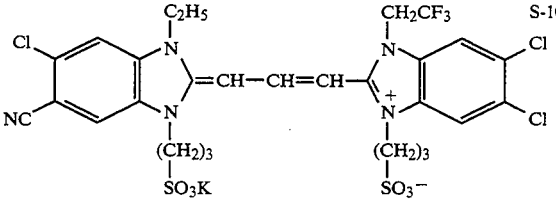
S-11
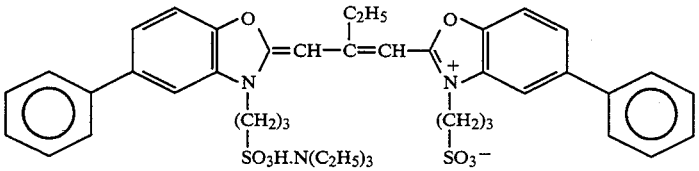
S-12
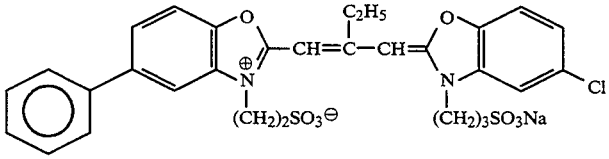
S-13
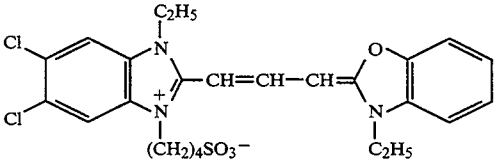
S-14
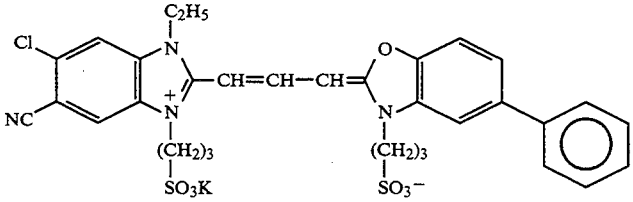

-continued
S-15
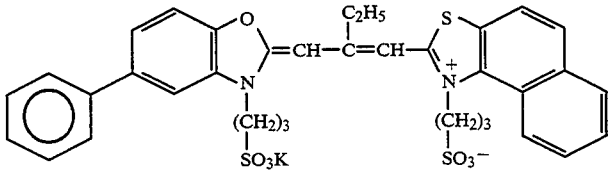
S-16
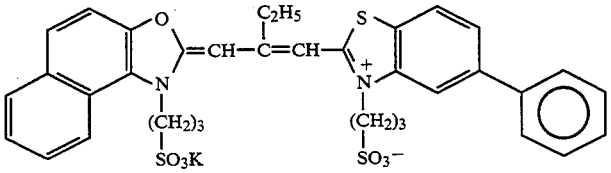
S-17
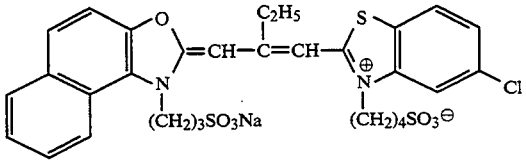
S-18
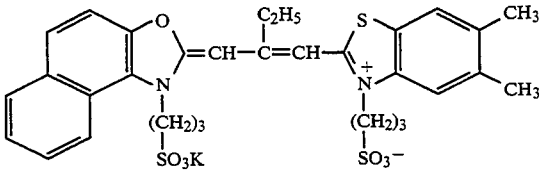
S-19
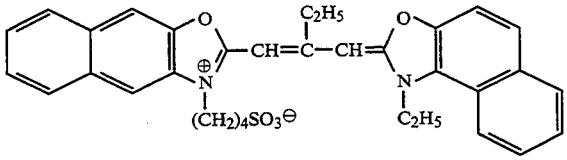
S-20
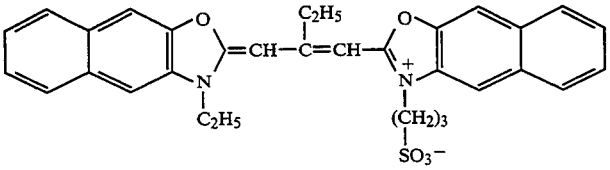
S-21
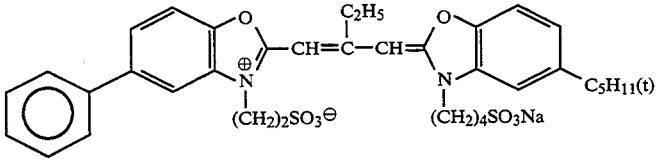
S-22
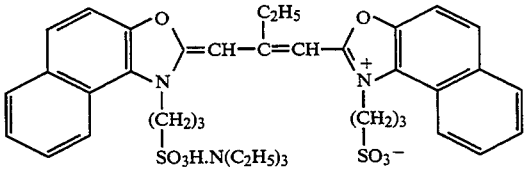
S-23
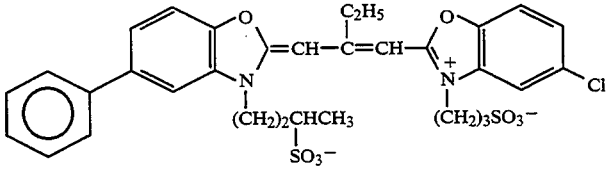

-continued
S-24
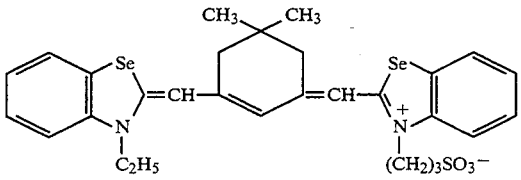
S-25
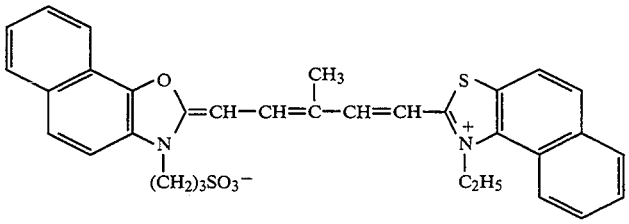
S-26
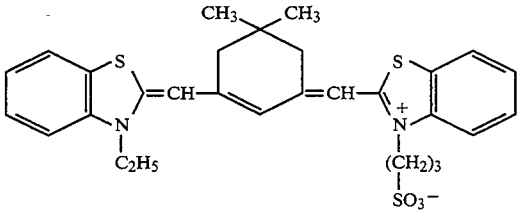
S-27
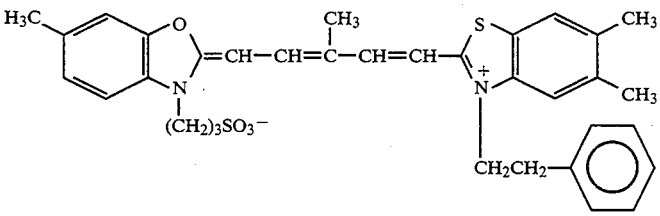
S-28
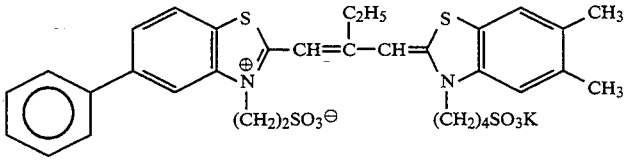
S-29
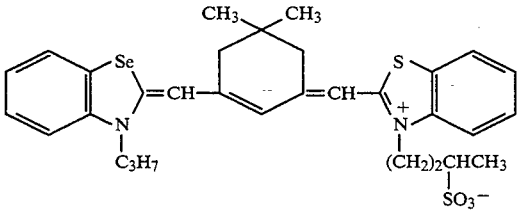
S-30
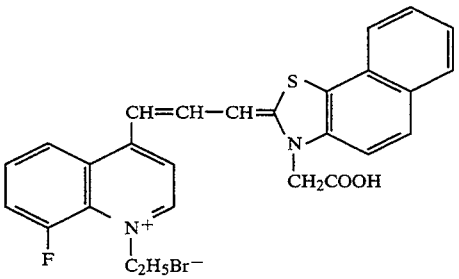
S-31
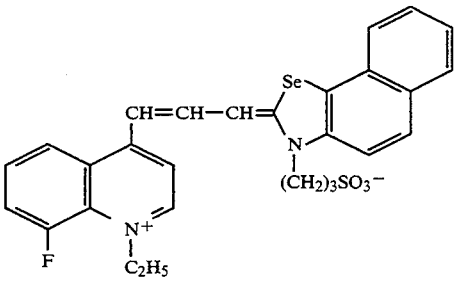
S-32
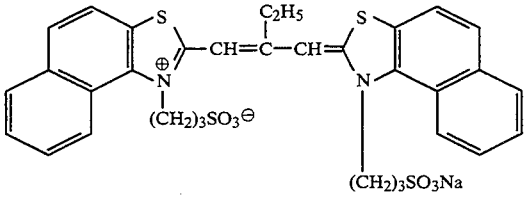

-continued
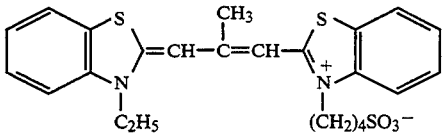
S-33
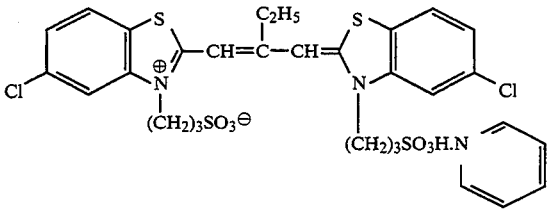
S-34
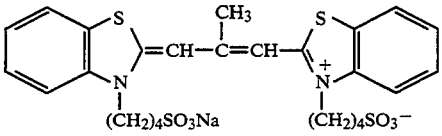
S-35
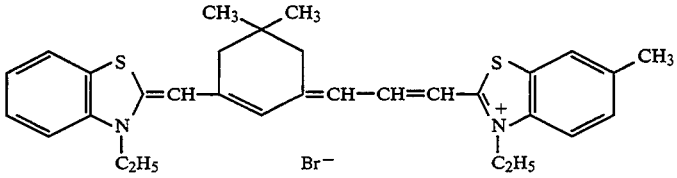
S-36
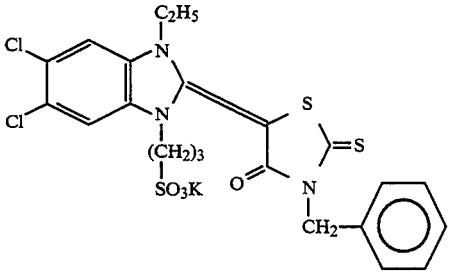
S-37
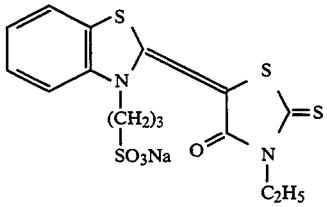
S-38
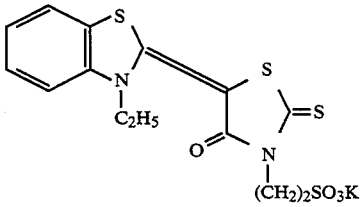
S-39
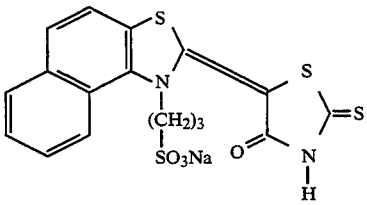
S-40
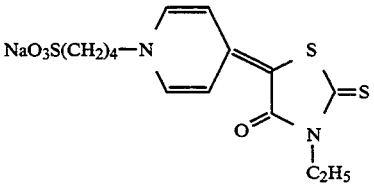
S-41
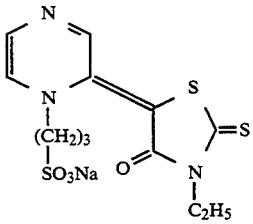
S-42
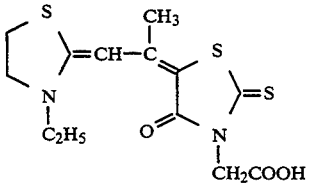
S-43
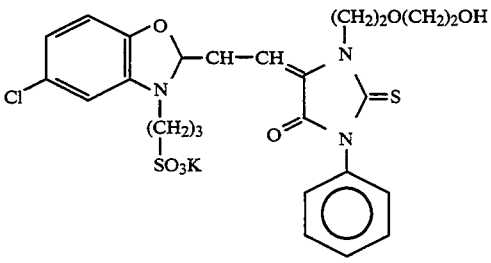
S-44

-continued

S-45

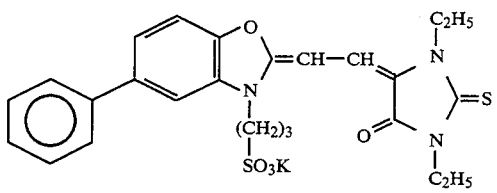

S-46

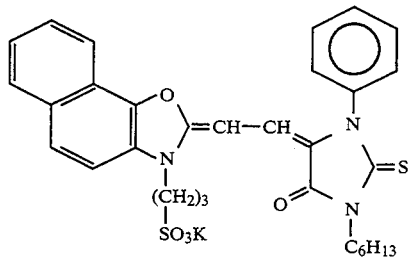

S-47

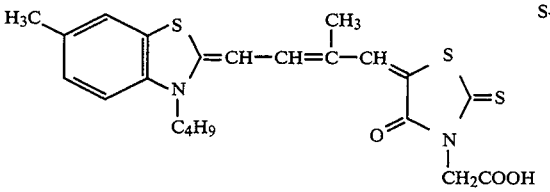

S-48

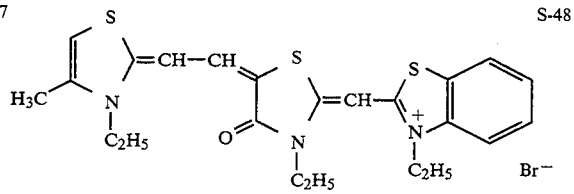

S-49

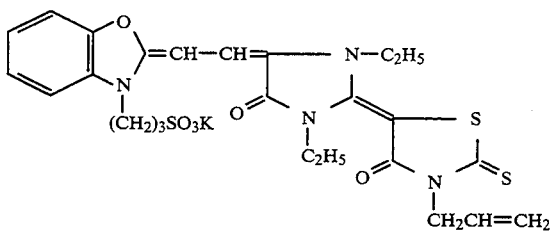

In the step of chemical sensitization in accordance with an embodiment-of the present invention, or when color sensitization carried out in combination therewith, various supersensitization techniques can be adopted. Examples of a combination of useful dyes, including supersensitizing combinations of dyes, are disclosed in U.S. Pat. Nos. 3,506,443 and 3,672,898. As for the supersensitizing combination of a spectral sensitizing dye with an additive which does not absorb light in the visible region, the use of a thiocyanate as such an additive in the course of spectral sensitization is disclosed in U.S. Pat. No. 2,221,805, the use of bistriazinylaminostilbene is disclosed in U.S. Pat. No. 2,933,390, the use of sulfonated aromatic compounds is disclosed in U.S. Pat. No. 2,937,089, the use of heterocyclic compounds substituted by a mercapto group is disclosed in U.S. Pat. No. 3,457,078, and the use of iodides is disclosed in British Patent 1,413,826.

In adding the spectral sensitizing dyes in the emulsion-making process of the present invention, various known methods can be used. For example, as described in U.S. Pat. No. 3,469,987, sensitizing dyes are dissolved in a volatile organic solvent, the solution obtained is dispersed into a hydrophilic colloid, and then the dispersion thus obtained is added to an emulsion. In a variation of this technique, sensitizing dyes are dissolved separately in the same or different solvents, and these solutions are added to an emulsion after mixing or separately without mixing.

Suitable examples of solvents used for adding sensitizing dyes to a silver halide emulsion include methyl alcohol, ethyl alcohol, acetone and other water miscible organic solvents.

The sensitizing dyes are added to a silver halide emulsion preferably in the range of from $1\times10^{-5}$ to $2.5\times10^{-3}$ mole, more preferably from $1.0\times10^{-4}$ to $1.0\times10^{-3}$ mole, per mole of silver halide.

The sensitizing dyes described above can be used in combination with other sensitizing dyes or supersensitizing agents. Also, materials which can exhibit a supersensitizing effect in combination with the above described sensitizing dyes, which materials of themselves do not spectrally sensitize a silver halide emulsion or do not absorb light in the visible region may be incorporated into a silver halide emulsion.

It is important in the present invention to carry out chemical sensitization selected from the group consisting of sulfur sensitization and gold sensitization. The location for chemical sensitization of the emulsion grains depends on the composition, structure, shape and intended application of the resulting emulsion. For example, the chemically sensitized nuclei may be buried deep in the grains, or may be buried in a shallow position under the grain surface, or may be formed at the grain surface. The effects of the present invention, although achieved in each of the above noted cases, are particularly remarkable in when the chemically sensitized nuclei are formed in the vicinity of the grain surface. Namely, the effects of the present invention are pronounced for surface latent image type emulsions as opposed to internal latent image type.

Chemical sensitization can be effected with active gelatin, as described in T. H. James, *The Photographic Process,* 4th Ed., pages 67–76, Macmillan (1977), or by using a sulfur sensitizer, a selenium sensitizer, a tellurium sensitizer, a gold sensitizer, a platinum sensitizer, a palladium sensitizer, an iridium sensitizer or a combination of two or more of these sensitizers at a temperature of 30°–80° C. under the conditions of pAg 5–10 and pH 5–8, as described in *Research Disclosure,* vol. 120, RD No. 12008 (Apr. 1974), *Research Disclosure,* vol. 34, RD No. 13452 (Jun. 1975), U.S. Pat. Nos. 2,642,361, 3,297,446, 3,772,031, 3,857,711, 3,901,714, 4,266,018 and 3,904,415, and British Patent 1,315,755.

Of gold sensitizers for use in the present invention, gold complex salts (e.g., those disclosed in U.S. Pat. No. 2,399,083) are preferred.

Among such complex salts, potassium chloroaurate, potassium aurithiocyanate, auric trichloride, sodium aurithiosulfate and 2-aurosulfobenzothiazole methochloride are particularly preferred.

The content of gold sensitizer in the individual silver halide grains ranges preferably from $10^{-9}$ to $10^{-3}$ mole, particularly from $10^{-8}$ to $10^{-4}$ mole, per mole of silver halide.

Useful examples of sulfur sensitizers include thiosulfates, thioureas, thiazoles, rhodanines and other compounds as disclosed in U.S. Pat. Nos. 1,574,944, 2,410,689, 2,278,947, 2,728,668, 3,656,955, 4,030,928 and 4,067,740. Among these compounds, thiosulfates, thioureas and rhodanines are preferred in particular.

The sulfur sensitizer is used in an optimum amount which is selected depending on the grain size and the conditions, including temperature, pAg and pH, under which chemical sensitization is carried out. The addition amount of the sulfur sensitizer is generally within the range of $10^{-7}$ to $10^{-3}$ mole, preferably $5\times10^{-7}$ to $1\times10^{-4}$ mole, more preferably $5\times10^{-7}$ to $1\times10^{-5}$ mole, per mole of silver halide.

The-chemical sensitization temperature can be appropriately selected in the range of from 40° C. to 90° C., the pAg in the range of from 5 to 10, and the pH at a value higher than 4.

Sensitization with metals, such as iridium, platinum, rhodium, palladium, etc. (as disclosed, e.g., in U.S. Pat. Nos. 2,448,060, 2,566,245 and 2,566,263), and selenium sensitization using a selenium compound can also be adopted in the present invention.

In addition, chemical sensitization can be carried out in the presence of chemical sensitization assistants. Examples of chemical sensitization assistants for use in the present invention include compounds known to suppress the generation of fog and to increase the sensitivity during the course of chemical sensitization, such as azaindenes, azapyridazines, azapyrimidines, etc. Examples of modifiers for the chemical sensitization assistants are described, e.g., in U.S. Pat. No. 2,131,038, 3,411,914 and 3,554,757, JP-A-58-126526, and G. F. Duffin, *Photographic Emulsion Chemistry,* pages 138–143, Focal Press, New York (1966).

The photographic material of the present invention comprises a support having thereon at least one light-sensitive silver halide emulsion layer, which layer may be a blue-sensitive, green-sensitive or red-sensitive layer. These silver halide emulsion layers and other light-insensitive layers are not particularly restricted as to the number of constituent layers and the arrangement order thereof. A typical example is a silver halide photographic material comparising a support having thereon at least one light-sensitive unit layer composed of two or more of silver halide emulsion layers which have substantially the same color sensitivity but different photographic speeds. The light-sensitive layer is a unit light-sensitive layer having color sensitivity to any of blue light, green light and red light. In a multilayer silver halide color photographic material, the unit light-sensitive are generally arranged in order of the a support, a red-sensitive layer, a green-sensitive layer and a blue-sensitive layer. However, the above noted order may be reversed, as needed. Also, a layer having a different light-sensitivity may be arranged between layers having the same color sensitivity.

Moreover, light-insensitive layers including various kinds of interlayers may be provided between the aforesaid silver halide light-sensitive layers, and as the uppermost and lowermost layer.

The interlayers may contain the couplers and DIR compounds as disclosed in JP-A-61-43748, JP-A-59-113438, JP-59-113440, JP-A-61-20037 and JP-A-61-20038, and may contain conventionally employed color mixing inhibitors.

The plurality of silver halide emulsion layers which constitute each of the unit light-sensitive layers can preferably assume a two-layer structure consisting of a high-speed emulsion layer and a slow emulsion layer, as disclosed in West German Patent 1,121,470 or British Patent 923,045. In general, the constituent layers of a unit light-sensitive layer are preferably arranged such that the photographic speed is successively decreased towards the support. Also, a light-insensitive layer may be disposed in between constituent layers of a unit light-sensitive layer. On the other hand, it is also possible to dispose a slow speed emulsion layer farthest from the support and a high-speed emulsion layer closest to the support, as disclosed, e.g., in JP-A-57-112751, JP-A-62-200350, JP-A-62-206541 and JP-A-62-206543.

More specifically, a slow blue-sensitive layer (BL), a high-speed blue-sensitive layer (BH), a high-speed green-sensitive layer (GH), a slow green-sensitive layer (GL), a high-speed red-sensitive layer (RH) and a slow red-sensitive layer (RL) can be arranged in the above order with (BL) being farthest from the support. Also, the arranging order of BH/BL/GL/GH/RH/RL/Support, that of BH/BL/GH/GL/RL/RH/Support, etc. may also be used.

In addition, the arranging order of Blue-sensitive layer/GH/RH/GL/RL/Support as disclosed in JP-B-55-34932 (The term "JP-B" as used herein means an "examined Japanese patent publication), and the arranging order of Blue-sensitive layer/GL/RL/GH/RH-/Support as disclosed in JP-A-56-25738 and JP-A-62-63936 can be adopted.

Also, three layers of a unit layer differing in photographic speed, as disclosed in JP-B-49-15495, may be arranged such that the photographic speed is decreased stepwise in the direction of the support. Namely, a silver halide emulsion layer of the highest speed as an upper layer, a silver halide emulsion layer having a speed lower than that of the upper layer as an intermediate layer, and a silver halide emulsion layer having a speed lower than that of the intermediate layer as the lowest layer. In a similar case wherein the unit light-sensitive layer has a three-layer structure, a medium-speed emulsion layer, a high-speed emulsion layer and a low-speed emulsion layer may be arranged in order with the medium-speed emulsion layer being farthest from the support, as disclosed in JP-A-59-202464. In addition, an arranging order of high-speed emulsion layer/low-speed emulsion layer/medium-speed emulsion layer, or an arranging order of-low-speed emulsion layer/medium-speed emulsion layer/high speed emulsion layer may be adopted. Also, for a unit light-sensitive layer constituted by four or more constituent layers, various arranging orders may be adopted similar to those described above.

For the purpose of improving color reproducibility, a donor layer (CL) providing an interimage effect which differs in the distribution of spectral sensitivity from that of a main light-sensitive layer such as BL, GL, RL, etc. may be arranged adjacent or near to the main light-sensitive layer.

As described above, the optimal layer structure and arrangement each can be selected depending on the intended application of the photographic material.

Additionally, silver halide grains for use in the present invention, other than the tabular silver halide grains that characterize the present invention, are described below.

Suitable silver halides contained in the photographic emulsion layers of the photographic light-sensitive material of the present invention include silver iodobromide, iodochloride or iodochlorobromide having an iodide content of about 30 mol % or less. Particularly preferred are silver iodobromide and iodochlorobromide having an iodide content of from about 2 mol % to about 10 mol %.

Silver halide grains in the photographic, emulsions may be those having a regular crystal form, such as that of a cube, an octahedron, a tetradecahedron, etc., or those having an irregular crystal form, such as that of a sphere, a plate, etc., those having crystal imperfections, such as a twinned plane, or those having a composite form of two or more of the above-noted crystal forms.

The silver halide emulsion grains may be fine grains having a grain size of about 0.2 μm or less, or coarse grains having a projected area diameter of up to 10 μm. Moreover, the silver halide emulsion grains may be polydisperse or monodisperse emulsions.

Silver halide photographic emulsions for use in this invention can be prepared using known methods described, e.g., in *Research Disclosure* (abbreviated as RD, hereinafter), No. 17643, pp. 22–23, entitled "I. Emulsion Preparation and Types", (December 1978); RD No. 18716, p. 648 (November 1979); RD No. 307105, pp. 863–865 (Nov. 1989); P. Glafkides, *Chemie et Phisique Photographique,* Paul Montel (1967); Duffin, *Photographic Emulsion Chemistry,* Focal Press (1966); V. L. Zelikman et al., *Making and Coating Photographic Emulsion,* Focal Press (1964); etc.

Furthermore, the monodisperse emulsions as disclosed in U.S. Pat. Nos. 3,574,628 and 3,655,394, British Patent 1,413,748, etc. are preferably used.

Furthermore, tabular grains having an aspect ratio higher than 5 can be used.

The tabular grains are readily prepared using the methods described, e.g., in Gutoff, *Photographic Science and Engineering,* volume 14, pages 248–257 (1970); U.S. Pat. Nos. 4,434,226, 4,414,310, 4,433,048 and 4,439,520; and British Patent 2,112,157.

The crystal structure of the grains may be uniform throughout the grain, or the interior and the surface of the grains may differ in halide composition, or the grains may assume a layer structure. Furthermore, silver halide grains in which crystal surfaces differing in halide composition are fused together through epitaxial growth, or emulsion grains in which silver halide grains are fused together with a salt other than a silver halide, such as silver thiocyanate, lead oxide or the like may be used. A mixture of grains with various crystal forms may be used.

The above-described emulsions may be those of a surface latent image type in which a latent image is formed predominantly at the surface of the grains, or those of an internal latent image type in which a latent image is formed mainly inside the grains, providing that the emulsion is a negative working emulsion. As for the emulsions of an internal latent image type, those having a core/shell structure as disclosed in JP-A-63-264740 may be used. Methods for making core/shell emulsions of the internal latent image type are disclosed in JP-A-59-133542. A thickness of the shell in these emulsion grains is preferably in the range of 3 to 40 nm, particularly 5 to 20 nm, depending on the photographic processing that the grains are to be subjected to.

Silver halide emulsions which have undergone physical ripening, chemical sensitization and spectral sensitization treatments are generally used. Additives for use in these steps are described in *Research Disclosure* Nos. 17643, 18716 and 307105, and the pages on which these additives are described are summarized in the Table shown below.

In the photographic material of the present invention, two or more emulsions differing in at least one characteristic among grain size, grain size distribution, halogen composition, grain form and sensitivity can be used in the same layer in the form of a mixture.

In light-sensitive silver halide emulsion layers and/or hydrophilic colloid layers which are substantially insensitive to light, silver halide grains the surface of which is fogged, as disclosed in U.S. Pat. No. 4,082,553, silver halide grains the interior of which is fogged, as disclosed in U.S. Pat. No. 4,626,498 and JP-A-59-214852, and colloidal silver can be used advantageously. The expression "silver halide grains the surface or inside of which is fogged" refers to silver halide grains which can uniformly undergo development (non-imagewise), independent of whether the grains are present in unexposed part or exposed part of the photographic material. Methods for preparing silver halide grains the inside or surface of which is fogged are disclosed in U.S. Pat. No. 4,626,498 and JP-A-59-214852.

The core of the core/shell emulsion grains which are fogged on the inside may have a halide composition uniform throught, or may have a distribution of halides. As for the silver halide which constitutes the silver halide grains fogged on the inside or at the surface, any of silver chloride, silver chlorobromide, silver iodobromide and silver chloroiodobromide can be sued. These fogged silver halide grains are not particularly limited with respect to grain size, but preferably have an average grain size within the range of 0.01 to 0.75 μm, particularly 0.05 to 0.6 μm. Also, there is no particular restriction on the form and the size distribution, such that these grains may have a regular crystal form and may be polydisperse. However, the grains are preferably monodisperse. The term monodisperse system as used herein refers to a disperse system wherein at least 95%, by weight or number, of the grains have individual sizes within the range of ±40% of the average grain size.

In the present invention, light-insensitive fine grain silver halide are preferably used. The term "light-insensitive fine grain silver halide" refers to fine grains of silver halide which are insensitive to an image pattern of light to which they are exposed, and are not developed in a substantial sense upon development-processing. Additionally, it is preferred that such fine grains are not fogged in advance.

The fine grain silver halide has a bromide content in the range of 0 to 100 mol %, and may contain chloride and/or iodide in any fraction(s), if desired. Preferably, the fine grain silver halide has an iodide content of 0.5 to 10 mol %.

The fine grain silver halide preferably has an average grain size (represented by the average of diameters of corresponding circles which have the same areas as the projected areas of grains, the individual of 0.01 to 0.5 μm, particularly 0.02 to 0.2 μm.

The fine grain silver halide can be prepared in the same manner as conventional light-sensitive silver halides. In this case, the surface of silver halide grains need not be sensitized optically or undergo spectral sensitization. However, known stabilizers, including compounds of triazole, azaindene, benzothiazolium or mercapto type, zinc compounds, etc., are preferably added prior to the addition of these fine grains to a coating composition. In a layer containing the above described fine grain silver halide, colloidal silver can be incorporated to advantage.

The silver coverage of the photographic material of the present invention is preferably less than 6.0 g/m$^2$, particularly less than 4.5 g/m$^2$.

In addition, other known photographic additives for use in the present invention are described in the above-cited three Research Disclosure volums, and the pages on which such additives are described are summarized in the following Table.

TABLE 1

| Emulsion No. | Unsensitized Emulsion | Average Aspect Ratio | Average Grain Size (μm) | Average Grain Thickness (μm) | Sensitizing Dye | Way of Dye Addition |
|---|---|---|---|---|---|---|
| 1* | I | 1.5 | 0.20 | 0.189 | B | i |
| 2* | " | " | " | " | G | " |
| 3* | " | " | " | " | R | " |
| 4 | II | 2.2 | 0.28 | 0.169 | B | " |
| 5 | " | " | " | " | G | " |
| 6 | " | " | " | " | R | " |
| 7 | III | 3.8 | 0.40 | 1.51 | B | " |
| 8 | " | " | " | " | G | " |
| 9 | " | " | " | " | R | " |
| 10 | IV | 4.5 | 0.42 | 0.137 | B | " |
| 11 | " | " | " | " | G | " |
| 12 | " | " | " | " | R | " |
| 13 | V | 5.0 | 0.44 | 0.125 | B | " |
| 14 | " | " | " | " | G | " |
| 15 | " | " | " | " | R | " |

*Comparative emulsions

In order to prevent deterrioration of photographic properties from deteriorating due to formaldehyde gas, a compound capable of fixing formaldehyde gas through the reaction therewith, as disclosed in U.S. Pat. No. 4,411,987 and 4,435,503, is preferably incorporated into the photographic material.

Furthermore, the photographic material of the present invention preferably contains mercapto compounds as disclosed in U.S. Pat. Nos. 4,740,454 and 4,788,132, JP-A-62-18539 and JP-A-01-283551.

Furthermore, the photographic material of the present invention preferably contains compounds as disclosed in JP-A-01-106052, which compounds can release a fogging agent, a development accelerator, a silver halide solvent or a precursor thereof, independent of the quantity of the developed silver which is obtained by development-processing.

In addition, the photographic material of the present invention preferably contains dyes dispersed in accordance with the method disclosed in WO 88/04794 or JP-A-01-502912, or dyes as disclosed in EP-A-0317308, U.S. Pat. No. 4,420,555, or JP-A-01-259358.

Various kinds of color couplers can be used in the present invention. Specific examples thereof are disclosed in the patents cited in the aforesaid RD 17643 (Items VII-C to VII-G), and RD 307105 (Items VII-C to VII-G).

Preferred yellow couplers include those disclosed, e.g., in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and EP-A-0249473.

Preferred magenta couplers include 5-pyrazolone compounds and pyrazoloazole compounds. In particular, those disclosed in U.S. Pat. Nos. 4,310,619 and 4,351,897, European Patent 73,636, U.S. Pat. Nos. 3,061,432 and 3,725, 067, RD 24220 (June 1984), JP-A-60-33552, RD 24230 (June 1984), JP-A.60-43659, JP-A-61-72238, JP-A-60-35730, JP-A-55-118034, JP-A-60-185951, U.S. Pat. Nos. 4,500,630, 4,540,654 and 4,556,630, WO(PCT) 88/04795 can be used to advantage.

Preferred cyan couplers include phenol and naphthol types, as disclosed, e.g., in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) 3,329,729, EP-A-0121365, EP-A-0249453, U.S. Pat. Nos. 3,446,622, 4,333,999, 4,775,616, 4,451,559, 4,427,767, 4,690,889, 4,254,212 and 4,296,199, and JP-A-61-42658.

Particularly, the cyan couplers disclosed in U.S. Pat. No. 4,333,999 and 4,609,889 are preferred. In addition, the pyrazoloazole type cyan couplers disclosed in JP-A-64-553, JP-A-64-554, JP-A-64-555 and JP-A-64-556, and the imidazole type cyan couplers disclosed in U.S. Pat. No. 4,818,672 can be used.

Typical examples of dye-forming couplers which assume a polymerized form are disclosed in U.S. Pat. Nos. 3,451,820, 4,080,211, 4,367,282, 4,409,320 and 4,576,910, British Patent 2,102,137,EP-A-0341188,, etc.

As for couplers which can form dyes of moderate diffusibility, those disclosed in U.S. Pat. No. 4,366,237, British Patent 2,125,570, European Patent 96,570 and West German Patent Application (OLS) 3,234,533 are used to advantage.

As for colored couplers for compensating unnecessary side absorption of the formed color image, those disclosed, e.g., in RD 17643 (Item VII-G) , RD 307105 (Item VII-G), U.S. Pat. No. 4,163,670, JP-B-57-39413, U.S. Pat. Nos. 4,004,929 and 4,138,258, and British Patent 1,146,368 are preferred. In addition, it is desirable to use couplers capable of compensating unnecessary side absorption of the formed color images by the release of fluorescent dyes upon coupling reaction as disclosed in U.S. Pat. No. 4,774,181; and the couplers having as a splitting-off group a dye precursor moiety capable of forming a dye by the reaction with a color developing agent, as disclosed in U.S. Pat. No. 4,777,120.

Also, couplers capable of releasing a photographically useful group in proportion to the progress of the coupling reaction can be used to advantage in the present invention. Preferred examples of couplers capable of releasing a development inhibitor, namely, DIR couplers, include those disclosed in the patents described in RD 17643 (Item VII-F) and RD 307105 (Item VII-F), JP-A-57-151944, JP-A-57-154234, JP-A-60-184248, JP-A-63-37346, JP-A-63-37350, and U.S. Pat. No. 4,248,962 and 4,782,012.

Bleach accelerator-releasing couplers as described in RD 11449, RD 24241, JP-A-61-201247, etc. are effective in reducing the time required for processing with a processing bath having a bleaching ability. In particular, the effects of such compounds are remarkable when added to a photographic material comprising the above described tabular silver halide grains. Preferred couplers capable of imagewise releasing a nucleating agent or a development accelerator upon development include those disclosed in British Patents 2,097,140 and 2,131,188, JP-A-59-157638 and JP-A-59-170840. Also, compounds of the type which can release a fogging agent, a development accelerator, a silver halide solvent, etc., by undergoing a redox reaction with the oxidized developing agent can be used, as disclosed in JP-A-60-107029, JP-A-60-252340, JP-A-01-44940 and JP-A-01-45687.

Other couplers for use in this invention include competing couplers as disclosed in U.S. Pat. No. 4,130,427; multiequivalent couplers as disclosed in U.S. Pat. Nos. 4,283,472, 4,338,393 and 4,310,618; DIR redox compound-releasing couplers, DIR coupler-releasing couplers, DIR coupler-releasing redox compounds or DIR redox compound-releasing redox compounds as disclosed in JP-A-60-185950 and JP-A-62-24252; couplers capable of releasing a dye which can recover its original color after elimination as disclosed in EP-A-0173302 and EP-A-0313308; ligand-releasing couplers as disclosed in U.S. Pat. No. 4,553,477; leuco dye-releasing couplers as disclosed in JP-A-63-75747; fluorescent dye-releasing couplers as disclosed in U.S. Pat. No. 4,774,181; etc.

Among these couplers, the compounds disclosed in EP 435,334A2, from page 3, line 1 to page 29, line 50 are preferably added to the photosensitive layer of the present invention.

Couplers usable in the present invention can be introduced into the photographic materials using various known dispersion methods.

Examples of high boiling solvents which can be used in the oil-in-water dispersion method are described, e.g., in U.S. Pat. No. 2,322,027.

More specifically, high boiling organic solvents having a boiling point of 175° C. or higher under ordinary pressure which can be used in the oil-in-water dispersion method include phthalic acid esters (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate, bis(1,1-diethylpropyl)phthalate), phosphoric or phosphonic acid esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoic acid esters (e.g., 2-ethylhexylbenzoate, dodecylbenzoate, 2-ethylhexyl-p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylic acid esters (e.g., bis(2-ethylhexyl)cebacate, dioctyl azelate, glycerol tributyrate, isostearyl lactate, trioctyl citrate), aniline derivatives (e.g., N,N-dibutyl-2-butoxy-5-tert-octylaniline), hydrocarbons (e.g., paraffin, dodecylbenzene, diisopropylnaphthalene), etc. In addition, organic solvents having. a boiling point of from about 30° C., preferably about 50° C., to about 160° C. can be used as an auxiliary solvent, typical examples thereof including ethyl acetate, butyl acetate, ethyl propionate, methyl ethyl ketone, cyclohexanone, 2-ethoxyethyl acetate, dimethylformamide, etc.

As for the latex dispersion method, dispersing processes and effects thereof, and latexes for use as impregnants are specifically described in U.S. Pat. No. 4,199,363, West German Patent Application (OLS) Nos. 2,541,274 and 2,541,230, etc.

It is desirable to add to the color photographic material of the present invention, various kinds of antiseptics or antimolds, e.g., phenetyl alcohol, and compounds disclosed in JP-A-63-257747, JP-A-62-272248 and JP-A-01-809411, namely 2-benzisothiazoline-3-one, n-butyl p-hydroxybenzoate, phenol, 4-chloro-3,5-dimethylphenol, 2-phenoxyethanol and 2-(4-thiazolyl)benzimidazole.

The present invention can be applied to various color photographic materials. Representative of such photographic materials are color negative films for amateur or motion picture use, color reversal films for slide or television use, color paper, color positive film, color reversal paper, etc.

Supports appropriately used in the present invention are described, e.g., in the above-cited references, or RD 17643 (page 28), and RD 18716 (from the right column on page 647 to the left column on page 648) and RD 307105 (page 879).

The photographic material of the present invention preferably has a total thickness of all of the hydrophilic colloid layers present on the emulsion layer side of 28 μm or less, preferably 23 μm or less, more preferably 18 μm or less, and particularly preferably 16 μm or less. On the other hand, the film swelling speed $T_{\frac{1}{2}}$ is preferably 30 seconds or less, preferably 20 seconds or less. The term film thickness refers to the film thickness measured after standing for 2 day's under conditions of 55% RH humidity at 25° C. The film swelling speed $T_{\frac{1}{2}}$ can be determined by known methods in the art. For example, the measurement can be effected by the use of a swellometer of the type described in A. Green et al., *Photgr. Sci. Eng.*, Vol. 19, No. 2, pp. 124–129. $T_{\frac{1}{2}}$ is defined as the time required to reach one-half of the saturated film thickness, which is taken as 90% of the maximum swollen film thickness attained when the film is processed with a color developer at 30° C. for 3 minutes and 15 seconds.

The film swelling speed $T_{\frac{1}{2}}$ can be adjusted to a proper value by adding a hardener to gelatin used as a binder, or by changing the storage condition after coating. Additionally, the swelling degree is preferably from 150 to 400%. The swelling degree can be calculated from the maximum swollen film thickness determined under the above-described condition, according to the following equation;

$$\frac{\text{(maximum swollen film thickness} - \text{film thickness)}}{\text{film thickness}}.$$

For the photographic material of the present invention, the hydrophilic colloid layers provided on the side of the support opposite the emulsion layer side (called a backing layer ) preferably have a total dry thickness of from 2 to 20 μm. The backing layers preferably contain the above-described light absorbers, filter dyes, ultraviolet absorbers, antistatic agents, hardeners, binders, plasticizers, coating aids, surfactants, etc. A suitable swelling degree of the backing layer ranges from 150 to 500%.

The color photographic material prepared in accordance with the present invention can be development processed using conventional methods as described in the foregoing RD 17643 (pages 28–29), RD 18716 (from left to right column on page 651) and RD 307105 (pages 880–881).

A color developing solution for the development processing of the photographic material of present invention is preferably an alkaline aqueous solution containing as a main component an aromatic primary amine type color developing agent. Preferred color developing agents are p-phenylenediamine compounds, although aminophenol compounds are also useful. Representative p-phenylenediamine compounds include 3-methyl-4-amino-N,N-di-ethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides or p-toluenesulfonates of the above-noted anilines. Among these compounds, 3-methyl-4-amino-N-ethyl-N-β-hydroxyethylaniline sulfate is preferred in particular. Also, two or more of the above-noted compounds can be used together, if desired.

In general, the color developing solution contains pH buffering agents such as carbonates, borates or phosphates of alkali metals, and development inhibitors or antifoggants such as chlorides, bromides, iodides, benzimidazoles, benzothiazoles or mercapto compounds. In addition, the color developing solution can optionally contain various kinds of preservatives, e.g., hydroxylamine, diethylhydroxylamine, sulfites, hydrazines such as N,N-biscarboxymethylhydrazine, phenylsemicarbazides, triethanolamine, catechol sulfonic acids, etc; organic solvents such as ethylene glycol, diethylene glycol, etc.; development accelerators such as benzyl alcohol, polyethylene glycol, quaternary ammonium salts, amines, etc.; dye forming couplers; competing couplers; auxiliary developers such as 1-phenyl-3-pyrazolidone, etc.; viscosity imparting agents; and various chelating agents represented by aminopolycarboxylic acids, aminopolyphosphonic acids, alkylphosphonic acids and phosphonocarboxylic acids, with specific examples including ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid), and salts of the above-noted acids.

In the case where reversal processing is carried out, black-and-white development and reversal processing are performed prior to color development. In a black-and-white developing solution, known black-and-white developing agents, such as dihydroxybenzenes including hydroquinone, 3-pyrazolidones including 1-phenyl-3-pyrazolidone, or aminophenols including N-methyl-p-aminophenol, can be used individually or in combination thereof.

The pH of the color developing solution and black-and-white developing solution ranges generally from 9 to 12. The replenishment amount for these developing solutions depends on the type of color photographic light-sensitive material to be processed, and is generally 3 l or less per $m^2$ of the photographic material processed. Also, the amount of replehisher can be reduced to 500 ml or less by lowering the bromide ion concentration in the replenisher. When a replenisher is used in a reduced amount, evaporation and aerial oxidation of the developing solution are desirably prevented by reducing the contact area between air and the developing solution in a processing tank. The contact area between air and a photographic processing solution in a processing tank can be represented by an Open Ratio defined as follows:

Open Rate=(contact area between processing solution and air ($cm^2$))÷(volume of processing solution ($cm^3$))

The open ratio described above is preferably controlled to 0.1 or less, more preferably from 0.001 to 0.05. For reducing the open ratio, in addition to placing a shield, such as a floating cover, on the surface of a processing solution contained in a processing tank, but also a method of using a mobile cover as disclosed in JP-A-01-82033, and a slit development processing method as disclosed in JP-A-63-216050 can be employed. Reduction of the open ratio is preferably applied to every process, including not only both color and black-and-white development and also all processes subsequent thereto, such as bleach, blix, fixation, washing and stabilization. Also, the replenisher amount can be reduced by adopting a measure for inhibiting the accumulation of bromide ion in the developing solution.

The time required for color development is generally within the range of 2 to 5 minutes, but can be shortened by carrying out the processing under conditions of high temperature and high pH, and by using a developing agent in high concentration.

Photographic emulsion layers are generally subjected to a bleach-processing after the color development. The bleach-processing may be carried out simultaneously with a fix-processing (blix-processing), or separately therefrom. In order to further increase processing speed, a blix-processing may be carried out after a bleach-processing. Also, processing may be carried out with two successive bleach-fix baths, a fix-processing may be carried out before a blix processing, or a bleach-processing may be carried out after a blix-processing. Namely, various processing combinations may be employed in desilvering, if desired. Examples of useful bleaching agents include compounds of polyvalent metals such as Fe(III) or the like, peroxy acids, quinones, nitro compounds, etc. Representative of such compounds are Fe(III) complex salts of organic acids, for example, aminopolycarboxylic acids (such as ethylenediaminetetraacetic acid, diethylenetriaminepentaacetic acid, cyclohexanediaminetetraacetic acid, methyliminodiacetic acid, 1,3-diaminopropanetetraacetic acid, glycoletherdiaminetetraacetic acid, etc.), citric acid, tartaric acid, malic acid, etc. Among these bleaching agents, (aminopolycarbonato)-iron(III) complex salts, such as (ethylenediaminetetraacetonato)iron(III)

complex salts and (1,3-diaminopropanetetraacetonato)iron(III) complex salts, are particularly favored for rapid processing and the prevention of environmental pollution. In addition, (aminopolycarbonato)iron(III) complex salts are especially useful in both bleaching and bleach-fix baths. The bleaching or bleach-fix bath utilizing an (aminopolycarbonato)iron(III) complex salt as noted above is generally adjusted to a pH range 4.0–8. For reducing processing time, processing may be carried at a pH lower than the above-described range.

In a bleaching bath, a bleach-fix bath and/or a prebath thereof, a bleach accelerator can be used, as needed. Specific examples of useful bleach accelerators include mercapto group- or disulfide linkage-containing compounds as disclosed in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure,* No. 17129 (July 1978); thiazolidine derivatives disclosed in JP-A-50-140129; thiourea derivatives disclosed in JP-B-45-8506, JP-A-52-20832, JP-A-53-32735 and U.S. Pat. No. 3,706,561; iodides disclosed in West German Patent 1,127,715 and JP-A-58-16235; polyoxyethylene compounds disclosed in West German Patents 966,410 and 2,748,430; polyamine compounds disclosed in JP-B-45-8836; the compounds disclosed in JP-A-49-40943, JP-A-49-59644, JP-A-53-94927, JP-A-54-35727, JP-A-55-26506 and JP-A-58-163940; and bromide ion. Among these compounds, compounds containing a mercapto group or a disulfide linkage are favored over others as providing a large bleach acceleration effect. In particular, those disclosed in U.S. Pat. No. 3,893,858, West German Patent 1,290,812 and JP-A-53-95630 are preferred. In addition, the compounds disclosed in U.S. Pat. No. 4,552,834 are desirable, too. Bleach accelerators as noted above may be incorporated into the photographic material. In the bleach-fix processing of color photographic materials for picture taking, such bleach accelerators as described above are especially effective.

In addition to the above-described compounds, the bleaching or bleach-fix bath preferably contains an organic acid for preventing bleach stain. Particularly preferred organic acids are those having an acid dissociation constant (pKa) of from 2 to 5, with specific examples including acetic acid, propionic acid, hydroxyacetic acid and the like.

Useful fixing agents include thiosulfates, thiocyanates, thioether compounds, thioureas, and iodide in large quantity. Among these, thiosulfates are generally used as the fixing agent. In particular, ammonium thiosulfate can be used in the widest range of applications. Also, the combined use of a thiosulfate with a thiocyanate, a thioether compound or a thiourea can be adopted to advantage. As for preservatives for the bleach-fix bath, sulfites, bisulfites, sulfinic acids, carbonyl-bisulfite adducts, or the sulfinic acid compounds disclosed in EP-A-0294769 are preferably employed. Further, various kinds of aminopolycarboxylic acids and organic phosphonic acids are preferably added to a fixing bath and bleach-fix bath for stabilization of the baths.

Preferably added to the fixing bath and the bleach-fix bath for use in the present invention are compounds having a pKa in the range of 6.0 to 9.0, with useful examples thereof including imidazoles such as imidazole, 1-methylimidazole, 1-ethylimidazole, 2-methylimidazole, etc., for pH adjustment.

The total time required for the desilvering steps is desirably as short as possible as long as satisfactory desilvering is obtained. Specifically, a suitable desilvering time is within the range of 1 to 3 minutes, particularly 1 to 2 minutes. The desilvering temperature ranges from 25° C. to 50° C., preferably from 35° C. to 45° C. In the preferred temperature range, the desilvering speed is increased, and the generation of processing stain is effectively prevented.

In the desilvering steps, the processing solutions are desirably agitated as vigorously as possible. Specific examples of methods for increasing the degree of agitation include forcing a jet stream of a processing solution against the emulsion surface of a photographic material (as disclosed in JP-A-62-183460), enhancing the agitation effect using a rotating means (as disclosed in JP-A-62-183461), enhancing the agitation effect by generating turbulence over the emulsion surface by moving a photographic material as the emulsion surface thereof comes into contact with a wiper blade installed in the processing bath, and increasing the circulated flow rate of the entire processing solution. These agitation enhancing means are effective in any of bleaching, bleach-fix and fixing baths. Enhancement of agitation can increase delivery of a bleaching agent and a fixing agent into the emulsion layers to thereby increase of the desilvering rate. In addition, the combined use of the above-described agitation enhancement means and a bleach accelerator can heighten the acceleration effect to a greater extent, and can hinder the fixation inhibiting action of the bleach accelerator.

The automatic processor for use in the present invention desirably has a photographic material carrying means as disclosed in JP-A-60-191257, JP-A-60-191258 and JP-A-60-191259. As disclosed in the above-cited JP-A-60-191267, such carrying means can markedly reduce the quantity of processing solution carried over into the postbath from the prebath, such that deterioration of the processing solution can be effectively prevented. Such means are particularly effective for reducing the processing time in each processing step and for reducing the amount of replenisher added to each processing bath.

After the desilvering processing, the silver halide color photographic .material of the present invention is generally subjected to a washing and/or stabilization processing. The amount of washing water required in the washing processing can be set depending on the characteristics of photographic material to be processed (e.g., the type of couplers incorporated therein), end-use application of the photographic material to be processed, the temperature of washing water, the number of the washing tanks (the number of stages), the manner of replenishing the washing water (e.g., counter-current replenishment, or otherwise), and various other factors. For example, the relation between the number of washing tanks and the amount of washing water in a multistage counter current process can be determined according to the methods described in *Journal of the Society of Motion Picture and Television Engineers,* volume 64, pages 248–253 (May 1955). According to the multistage counter current process described in the above-cited literature reference, the amount of washing water can be markedly decreased. However, bacteria disadvantageously tend to proliferate in the processing tanks due to the increased residence time of water in the tanks to produce suspended matter, and the resulting suspended matter adheres to the photographic materials processed therein. As the means of solving the above described problem, the method of lowering calcium and magnesium ion concentrations, as disclosed in JP-A-62-288838, can be employed to great advantage. Further, bactericides such as isothiazolone compounds and thiabendazole compounds disclosed in JP-A-57-8542; chlorine containing germicides such as sodium salt of chlorinated isocyanuric acid; and other germicides such as benzotriazoles, etc., as described in Hiroshi Horiguchi, *Bohkin Bohbai no Kagaku* (which means "antibacterial and moldproof chemistry"), Sankyo Shuppan (1986); *Biseibutsu no Mekkin Sakkin Bohbai Gijutsu* (which means "arts of sterilizing and pasteurizing microbes, and proofing against molds"), compiled by Eisei Gijutsukai, published by Kogyo Gijutsu Kai in 1982; and *Bohkin-Bohbazai Jiten* (which may be translated to "Thesaurus of Antibacterial Agents and Antimolds"), compiled by Nippon Bohkin Bohbai Gakkai.

A suitable pH of the washing water for processing the photosensitive material of this invention ranges from 4 to 9, more preferably from 5 to 8. The washing temperature and time varies depending on the characteristics and the intended use of the photosensitive materials to be processed, but are generally within the range of 20 seconds to 10 minutes at a temperature from 15° C. to 45° C., preferably 30, seconds to 5 minutes at a temperature from 25° C. to 40° C. Also, the photographic material of this invention can be processed directly with a stabilizer instead of undergoing the above-described washing processing. To such stabilization processing, all of known methods as disclosed in JP-A-57-8543, JP-A-58-14834 and JP-A-60-220345 can be applied.

On the other hand, stabilization processing may be carried out subsequently to the above-described washing processing. For example, a stabilizing bath containing a dye stabilizer and a surfactant is advantageously used as the final bath for processing of color photographic materials for picture taking use. Useful examples of the dye stabilizer include aldehydes such as formaldehyde, glutaraldehyde, etc., N-methylol compounds, hexamethylenetetramine, and aldehyde-sulfite adducts. To the stabilizing bath can be added various kinds of chelating agents and antimolds.

A solution overflowing the washing bath and/or the stabilizing bath in proportion to the replenishment thereof can be reused in another processing step, such as a desilvering step.

It is desirable to add water to each processing bath to compensate for spontaneous evaporation when using an automatic processor.

A color developing agent may be incorporated into the silver halide color photographic material of this invention to simplity and expedite photographic processing. The color developing agent, incorporated into the photographic material is desirably used in the form of a precursor, which can include various types of precursors. Examples of such precursors include indoaniline compounds disclosed in U.S. Pat. No. 3,342,597, compounds of Schiff base type disclosed in U.S. Pat. No. 3,342,599, *Research Disclosure,* No. 14850, and ibid. No. 15159, aldol compounds disclosed in *Research Disclosure* No. 13924, metal complexes disclosed in U.S. Pat. No. 3,719,492, and urethane compounds disclosed in JP-A-53-135628.

In the silver halide color photographic material of this invention, various types of 1-phenyl-3-pyrazolidones may be incorporated for acceleration color development, as needed. Typical examples of such pyrazolidones are disclosed in JP-A-56-64339, JP-A-57-144547, JP-A-58-115438 and so on.

The various processing solutions in this invention are used in the temperature range of 10° C. to 50° C. Although a standard temperature is generally within the range of 33° C. to 38° C., temperatures higher than the above range can be selected to reduce the processing time through acceleration of the processing, or a lower temperature can be selected in order to improve image quality and to enhance stability of the processing bath.

Also, the silver halide photographic material of the present invention can be applied to heat developable photosensitive materials as disclosed in U.S. Pat. No. 4,500,626, JP-A-60-133449, JP-A-59-218443, JP-A-61-238056, EP-A-0210660, etc.

The present invention will now be illustrated in greater detail by reference to the following examples. However, the invention should not be construed as being limited to these examples. In the Examples, part and percent are by weight unless otherwise specified.

EXAMPLE 1

An aqueous solution prepared by dissolving 10 g of inert gelatin and 3 g of potassium bromide in 1 l of water was being stirred at 40° C. Thereto, 100 ml of an aqueous solution containing 20 g of silver nitrate and an aqueous solution containing 13.7 g of potassium bromide and 0.86 g of potassium iodide were added over a 2-minute period each at the same flow rate of 500 ml/min. Then, the pAg of the reaction mixture was raised to 10, and 20 g of inert gelatin was further added. The resulting reaction mixture was ripened for 30 minutes as the temperature was raised to 75° C. and maintained. Thus, a core emulsion was prepared.

To the thus obtained emulsion, 100 ml of an aqueous solution containing 28 g of silver nitrate and an aqueous solution containing a mixture of potassium bromide and potassium iodide were added in equivalent mole portions at an addition rate close to the critical growth speed, to prepare a tabular silver iodobromide emulsion. The aspect ratio of the emulsion was controlled by selecting the pAg upon the addition of the second stage. Thus, an unsensitized emulsion I-VII was prepared. The unsensitized emulsion has a uniform constitution containing 4.4 mol % of silver iodide.

A water solution prepared by dissolving 10 g of inert gelatin and 3 g of potassium bromide in 1 l of distilled water was stirred at 40° C. Thereto, 100 ml of an aqueous solution containing 20 g of silver nitrate and an aqueous solution containing 13.7 g of potassium bromide and 0.86 g of potassium iodide were added over a 2-minute period each at the same flow rate of 50 ml/min. Then, the pAg of the reaction mixture was raised to 10, and 20 g of inert gelatin was further added. The resulting reaction mixture was ripened for 30 minutes as the temperature was raised to 75° C. and maintained. Thus, a core emulsion was prepared.

To the thus obtained emulsion, 100 ml of an aqueous solution containing 28 g of silver nitrate and an aqueous solution containing a mixture in 91/9 mole ratio of potassium bromide and potassium iodide were added at an addition rate close to the critical growth speed to prepare a an emulsion VIII having a uniform constitution containing 10 mol % of silver iodobromide.

Emulsions IX and X having a uniform constitution and each containing 6.0 and 5.2 mol % of silver iodide were prepared in the same manner as used in the preparation of the emulsion VIII, except that a mol ratio in a mixture of potassium bromide and potassium iodide to be added to the halide solution was varied.

Emulsions XI and XII were prepared as follows. A core emulsion, containing core grains, which contains 17 mol % of silver iodide was prepared in the same manner as used in the emulsion VIII except that a mol ratio in a mixture of potassium bromide and potassium iodide was varied.

After water washing the core grains for desalting thereof, 100 ml of an aqueous solution containing 28 g of silver nitrate was added to the emulsion at an addition rate close to the critical growth speed. The pAg was maintained at 7.6 by the addition of the mixture of the potassium bromide and potassium iodide in 91/9 mol ratio.

On preparing the emulsion XI, $2\times10^{-4}$ mol of the exemplified Compound M-1 was added and absorbed prior to the shell forming steps.

Both emulsions XI and XII are confirmed to contain silver iodide comprising 17 mol % of core and 4.4 mol % of shell by a calculation. By X-ray diffraction, the emulsion XI was evaluated having a distinctive layer constitution, whereas the emulsion XII does not form layer constitution.

After the conclusion of the addition, a spectral sensitizing dye was added, and after a 10-minutes lapse of time the temperature of the emulsion was reduced. The dye was selected from among R, G and B described below depending on the purpose of addition.

R: Spectral sensitizing dye for a red-sensitive layer
A mixture of Compounds S-17, S-34 and S-32 were used in a mole ratio of 10:30:1.

G: Spectral sensitizing dye for a green-sensitive layer
A mixture of Compounds S-12, S-19 and S-28 were used in a mole ratio of 50:20:3.

B: Spectral sensitizing dye for a blue-sensitive layer
Compounds S-3 was used.

An amount of the dyes added was determined such that the spectral sensitization sensitivity of each emulsion, which had already been subjected to gold-sulfur sensitization under optimal conditions, was maximized when evaluated following an exposure of 1/100 of a second.

The thus prepared emulsion comprised tabular grains, the proportion of which was at least 85% to all of the grains present in the emulsion on a projected area basis. The average sphere equivalent diameter was 0.3 μm.

For the purpose of desalting, a conventional washing step was carried out after the grain formation, and then redispersion was performed at 40° C. under conditions of pAg 8.5 and pH 6.5.

Chemical sensitization of each emulsion was performed at 64° C. using chloroauric acid and sodium thiosulfate, such that the spectral sensitization sensitivity evaluated following an exposure of 1/100 of a second was maximized. In a manner similar to above, various emulsions were prepared.

Other emulsions were prepared such that the same unsensitized emulsions, I to VII, were used, but sensitizing dyes were added in a different way. The manner of adding a sensitizing dye was selected from those described below.

i. (Adding a sensitizing dye between the conclusion of grain formation and the start of desalting, as described above.)
ii. Adding a sensitizing dye at the start of chemical sensitization subsequent to the desalting step.
iii. Adding a sensitizing dye at the time when 80% of the entire chemical ripening step was completed.
iv. Adding a sensitizing dye at the time when the temperature of the emulsion was lowered to 40° C. following conclusion of chemical sensitization.

For each addition method, the amount of the sensitizing dye used and the conditions for chemical sensitization were determined so as to produce the optimal result.

The thus prepared emulsions 1 to 45 are summarized in Table 1 and Table 2 below.

TABLE 1

| Emulsion No. | Unsensitized Emulsion | Average Aspect Ratio | Average Grain Size (μm) | Average Grain Thickness (μm) | Sensitizing Dye | Way of Dye Addition |
|---|---|---|---|---|---|---|
| 1* | I | 1.5 | 0.20 | 0.189 | B | i |
| 2* | " | " | " | " | G | " |
| 3* | " | " | " | " | R | " |
| 4 | II | 2.2 | 0.28 | 0.169 | B | " |
| 5 | " | " | " | " | G | " |
| 6 | " | " | " | " | R | " |
| 7 | III | 3.8 | 0.40 | 0.151 | B | " |
| 8 | " | " | " | " | G | " |
| 9 | " | " | " | " | R | " |
| 10 | IV | 4.5 | 0.42 | 0.137 | B | " |
| 11 | " | " | " | " | G | " |
| 12 | " | " | " | " | R | " |
| 13 | V | 5.0 | 0.44 | 0.125 | B | " |
| 14 | " | " | " | " | G | " |
| 15 | " | " | " | " | R | " |

*Comparative emulsions

TABLE 2

| Emulsion No. | Unsensitized Emulsion | Average Aspect Ratio | Average Grain Size (μm) | Average Grain Thickness (μm) | Sensitizing Dye | Way of Dye Addition |
|---|---|---|---|---|---|---|
| 16* | VI | 8.1 | 0.56 | 0.096 | B | i |
| 17* | " | " | " | " | G | " |
| 18* | " | " | " | " | R | " |
| 19* | VII | 10.3 | 0.63 | 0.073 | B | " |
| 20* | " | " | " | " | G | " |
| 21* | " | " | " | " | R | " |

TABLE 2-continued

| Emulsion No. | Unsensitized Emulsion | Average Aspect Ratio | Average Grain Size (μm) | Average Grain Thickness (μm) | Sensitizing Dye | Way of Dye Addition |
|---|---|---|---|---|---|---|
| 22 | IV | 4.5 | 0.42 | 0.137 | B | ii |
| 23 | " | " | " | " | G | " |
| 24 | " | " | " | " | R | " |
| 25 | " | " | " | " | B | iii |
| 26 | " | " | " | " | G | " |
| 27 | " | " | " | " | R | " |
| 28* | " | " | " | " | B | iv |
| 29* | " | " | " | " | G | " |
| 30 | " | " | " | " | R | " |
| 31 | VIII | 4.3 | 0.45 | 0.141 | B | ii |
| 32 | " | " | " | " | G | " |
| 33 | " | " | " | " | R | " |
| 34 | IX | 4.5 | 0.48 | 0.140 | B | " |
| 35 | " | " | " | " | G | " |
| 36 | " | " | " | " | R | " |
| 37 | X | 4.7 | 0.41 | 0.144 | B | " |
| 38 | " | " | " | " | G | " |
| 39 | " | " | " | " | R | " |
| 40 | XI | " | 0.42 | 0.140 | B | " |
| 41 | " | " | " | " | G | " |
| 42 | " | " | " | " | R | " |
| 43 | XII | 4.6 | 0.44 | 0.142 | B | " |
| 44 | " | " | " | " | G | " |
| 45 | " | " | " | " | R | " |

*Comparative emulsions

On a cellulose triacetate film support provided with a subbing layer, an emulsion prepared using a prescribed spectral sensitizing dye for imparting blue sensitivity thereto selected from the emulsions set forth in the above Tables, and a coating composition for a protective layer were coated, in order, at the respective coverages described below.

(1) Emulsion Layer:

| | |
|---|---|
| Emulsion No. 1, 4, 7, 10, 13, 16, 19, 22, 25, 28, 31, 34, 37, 40 or 43 as set forth in Table 1 or Table 2 | Ag coverage $1.7 \times 10^{-2}$ mole/m$^2$ |
| Coupler illustrated below | $1.5 \times 10^{-3}$ mole/m$^2$ |

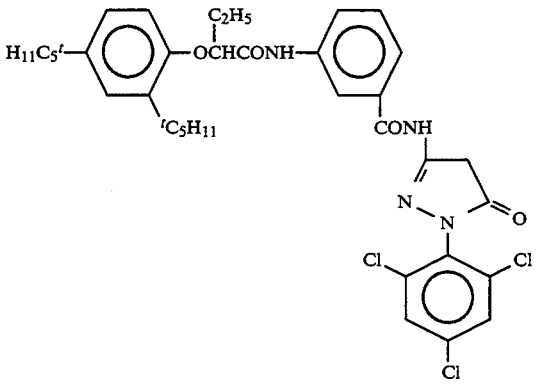

| | |
|---|---|
| Tricresyl phosphate | 1.10 g/m$^2$ |
| Gelatin | 2.30 g/m$^2$ |
| (2) Protective Layer: | |
| Sodium 2,4-dichloro-6-hydroxy-s-triazine | 0.08 g/m$^2$ |
| Gelatin | 1.80 g/m$^2$ |

On the other hand, other portions of each individual emulsion used for preparing the foregoing samples were stored for 8 hours at 40° C., and then used for coating to prepare additional samples.

The samples thus prepared were subjected to 1/100 second exposure for sensitometry, and then to the color photographic processing described below.

The processed samples were evaluated for sensitivity and fog density by measuring their respective developed color densities through a green filter. The sensitivities were evaluated with respect to an exposure yielding the optical density of (fog+0.2), and then compared relative to sample 11A being taken as 100. The results are shown in Table 3 below.

Processing Conditions

| Processing Step | Processing Time | Processing Temperature |
|---|---|---|
| Color development | 2 min. 45 sec. | 38° C. |
| Bleach | 6 min. 30 sec. | 38° C. |
| Washing | 2 min. 10 sec. | 24° C. |
| Fixation | 4 min. 20 sec. | 38° C. |
| Washing (1) | 1 min. 05 sec. | 24° C. |
| Washing (2) | 1 min. 00 sec. | 24° C. |
| Stabilization | 1 min. 05 sec. | 38° C. |
| Drying | 4 min. 20 sec. | 55° C. |

The composition of each processing bath used is described below.

| | |
|---|---|
| Color Developer: | |
| Diethylenetriaminepenta-acetic acid | 1.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-[N-ethyl-N-β-hydroxy-ethylamino]-2-methyl-aniline sulfate | 4.5 g |
| Water to make | 1.0 l |
| pH | 10.05 |
| Bleaching Bath: | |
| Sodium ethylenediaminetetra-acetatoferrate(III) trihydrate | 100.0 g |
| Disodium ethylenediamine-tetraacetate | 10.0 g |
| Ammonium bromide | 140.0 g |
| Ammonium nitrate | 30.0 g |
| Aqueous ammonia (27 wt %) | 6.5 ml |
| Water to make | 1.0 l |
| pH | 6.0 |

-continued

| | |
|---|---|
| Fixing Bath: | |
| Disodium ethylenediamine-tetraacetate | 0.5 g |
| Sodium sulfite | 7.0 g |
| Sodium hydrogen sulfite | 5.0 g |
| Aqueous solution of ammonium thiosulfate (70 wt %) | 170.0 ml |
| Water to make | 1.0 l |
| pH | 6.7 |
| Stabilizing Bath: | |
| Formaldehyde (37 wt %) | 2.0 ml |
| Polyoxyethylene-p-monononyl-phenylether(average polymerization degree: 10) | 0.3 g |
| Disodium ethylenediamine-tetraacetate | 0.05 g |
| Water to make | 1.0 l |
| pH | 5.0–8.0 |

An evaluation of the stress characteristics of the samples prepared as described above was conducted as follows: Each sample was wound around a columnar rod having a diameter of 6 mm o with the respective emulsion layers facing the inside, and held in that position for 10 seconds. Thereafter, the unrolled samples each were subjected to as exposure of 1/100 second using a stepwedge under the same condition as described above. The exposed samples were then subjected to the same photographic processing as described above. The densities of the thus developed color images were measured through a green filter, to determine the sensitivities and fog densities of the samples. The results obtained are set forth in Table 3. Therein, the sensitivities are shown as relative, to Sample 11A taken as 100.

TABLE 3

| Sample No. | Emulsion No. | Sensitivity | Fog | Sensitivity After Bending | Fog | Note |
|---|---|---|---|---|---|---|
| 11A | 1 | 100 | 0.10 | 100 | 0.23 | Comparison |
| 11B | " | 90 | 0.13 | — | — | " |
| 12A | 4 | 105 | 0.08 | 105 | 0.21 | Invention |
| 12B | " | 95 | 0.11 | — | — | " |
| 13A | 7 | 107 | 0.10 | 107 | 0.20 | " |
| 13B | " | 103 | 0.12 | — | — | " |
| 14A | 10 | 110 | 0.09 | 109 | 0.23 | " |
| 14B | " | 107 | 0.10 | — | — | " |
| 15A | 13 | 107 | 0.11 | 93 | 0.28 | " |
| 15B | " | 88 | 0.18 | — | — | " |
| 16A | 16 | 109 | 0.10 | 81 | 0.37 | Comparison |
| 16B | " | 82 | 0.20 | — | — | " |
| 17A | 19 | 112 | 0.08 | 77 | 0.42 | " |
| 17B | " | 75 | 0.32 | — | — | " |
| 18A | 22 | 106 | 0.11 | 101 | 0.12 | Invention |
| 18B | " | 101 | 0.13 | — | — | " |
| 19A | 25 | 102 | 0.11 | 98 | 0.23 | " |
| 19B | " | 90 | 0.17 | — | — | " |
| 20A | 28 | 95 | 0.13 | 92 | 0.24 | Comparison |
| 20B | " | 70 | 0.33 | — | — | " |
| 21A | 31 | 116 | 0.07 | 115 | 0.15 | Invention |
| 21B | " | 114 | 0.08 | — | — | " |
| 22A | 34 | 114 | 0.09 | 113 | 0.17 | " |
| 22B | " | 111 | 0.10 | — | — | " |
| 23A | 37 | 112 | 0.09 | 110 | 0.21 | " |
| 23B | " | 107 | 0.10 | — | — | " |
| 24A | 40 | 122 | 0.09 | 120 | 0.12 | " |
| 24B | " | 120 | 0.10 | — | — | " |
| 25A | 43 | 116 | 0.08 | 113 | 0.17 | " |
| 25B | " | 110 | 0.10 | — | — | " |

In the above Table, the samples bearing the "A" designation were prepared using as their respective coating compositions the emulsions stored for 30 minutes at 40° C. after preparation, while the samples bearing the "B" designation were prepared using as their respective coating compositions the emulsions stored for 8 hours at 40° C. after preparation.

As clearly seen from Table 3, the color photographic materials prepared in accordance with the present invention had not only exhibited high sensitivity, but also excellent stress resistance. In addition, the emulsions used therein as coating compositions were demonstrated to have excellent storage stability.

EXAMPLE 2

Samples were prepared in the same manner as in Example 1, except that the emulsions containing the sensitizing dyes for imparting green sensitivity instead of blue sensitivity, namely Emulsion Nos. 2, 5, 8, 11, 14, 17, 20, 23, 26, 32, 35, 38, 41 and 44 were used, respectively. Sensitometry evaluations were carried out in the same manner as in Example 1, except that the exposure was performed through a yellow filter (SC-52, made by Fuji Photo Film Co., Ltd.) in place of the green filter.

As a result of these experiments, the effects of the present invention were confirmed.

EXAMPLE 3

Samples were prepared in the same manner as in Example 1, except that the emulsions containing the sensitizing dyes for imparting red sensitivity instead of blue sensitivity, namely Emulsion Nos. 3, 6, 9, 12, 15, 18, 21, 24, 27, 30, 33, 36, 39, 42 and 45, were used, respectively. In this example, Compound M-2 was used together with the spectral sensitizing dye in an amount of $5\times10^{-5}$ mol/mol Ag.

Evaluations were made in the same manner as in Example 2, to thereby also confirm the effects of the present invention.

Further, similar results were obtained in evaluations using the emulsions containing Compound 32 alone instead of the combination of Compounds S-17, S-34 and S-32, wherein the spectral sensitization sensitivity was adjusted to be optimal for a 10 seconds exposure.

EXAMPLE 4

On a cellulose triacetate film support provided with a subbing layer, the layers having the compositions described below were coated in the order of description to prepare a multilayer color photographic material (designated Sample 401).

With respect to the composition of each constituent layer, the coverages of the silver halide emulsions and colloidal silver are expressed in g/m$^2$ on a silver basis, while the coverages of couplers, additives and gelatin are expressed in g/m$^2$, and the coverages of the sensitizing dyes are expressed in moles per mole of silver halide contained in the same layer. The figures on the right represent the coverage amount for the indicated component.

| | |
|---|---|
| First Layer (antihalation layer) | |
| Black colloidal silver | 0.15 as Ag |
| Gelatin | 1.90 |
| ExM-1 | $5.0 \times 10^{-3}$ |
| Second Layer (interlayer) | |
| Gelatin | 2.10 |
| UV-1 | $3.0 \times 10^{-2}$ |
| UV-2 | $6.0 \times 10^{-2}$ |
| UV-3 | $7.0 \times 10^{-2}$ |
| ExF-1 | $4.0 \times 10^{-3}$ |
| Solv-2 | $7.0 \times 10^{-2}$ |
| Third Layer (slow red-sensitive layer) | |
| Emulsion No. 3 prepared in Example 1 | 0.48 as Ag |
| Gelatin | 1.50 |
| ExC-1 | 0.11 |
| ExC-3 | 0.11 |
| ExC-4 | $3.0 \times 10^{-2}$ |
| ExC-7 | $1.0 \times 10^{-2}$ |
| Solv-1 | $7.0 \times 10^{-3}$ |
| Fourth Layer (medium red-sensitive layer | |
| Silver iodobromide emulsion (comprising grains having an average iodide content of 3 mole %, a high iodide content in the inner part, a sphere corresponding diameter of 0.55 μm, a variation coefficient of 20% with respect to the diameter distribution, a regular crystal form, and an aspect ratio of 1.0) | 0.90 as Ag |
| Gelatin | 2.00 |
| S-17 | $1.0 \times 10^{-4}$ |
| S-34 | $3.0 \times 10^{-4}$ |
| S-32 | $1.0 \times 10^{-5}$ |
| ExC-1 | 0.16 |
| ExC-2 | $8.0 \times 10^{-2}$ |
| ExC-3 | 0.17 |
| ExC-7 | $1.5 \times 10^{-2}$ |
| ExY-1 | $2.0 \times 10^{-2}$ |
| ExY-2 | $1.0 \times 10^{-2}$ |
| Cpd-10 | $1.0 \times 10^{-4}$ |
| Solv-1 | 0.10 |
| Fifth Layer (fast red-sensitive layer) | |
| Silver iodobromide emulsion (comprising grains having an average iodide content of 8 mole %, a high iodide content in the inner part, a sphere corresponding diameter of 0.72 μm, a variation coefficient of 30% with respect to the diameter distribution, a twinned crystal form, and an aspect ratio of 1.5) | 0.75 as Ag |
| Gelatin | 1.60 |
| S-17 | $1.0 \times 10^{-4}$ |
| S-34 | $3.0 \times 10^{-4}$ |
| S-32 | $1.0 \times 10^{-5}$ |

-continued

| | |
|---|---|
| ExC-5 | $7.0 \times 10^{-2}$ |
| ExC-6 | $8.0 \times 10^{-2}$ |
| ExC-7 | $1.5 \times 10^{-2}$ |
| Solv-1 | 0.15 |
| Solv-2 | $8.0 \times 10^{-2}$ |
| Sixth Layer (intermediate layer) | |
| Gelatin | 1.10 |
| P-2 | 0.17 |
| Cpd-1 | 0.10 |
| Cpd-4 | 0.17 |
| Solv-1 | $5.0 \times 10^{-2}$ |
| Seventh Layer (slow green-sensitive layer) | |
| Emulsion No. 2 prepared in Example 1 | 0.35 as Ag |
| Gelatin | 0.50 |
| ExM-1 | $3.0 \times 10^{-2}$ |
| ExM-2 | 0.20 |
| ExY-1 | $3.0 \times 10^{-2}$ |
| Cpd-11 | $7.0 \times 10^{-2}$ |
| Solv-1 | 0.20 |
| Fighth Layer (medium green-sensitive layer) | |
| Silver iodobromide emulsion (comprising grains having an average iodide content of 3 mole %, a high iodide content in the inner part, a sphere corresponding diameter of 0.55 μm, a variation coefficient of 20% with respect to the diameter distribution, a regular crystal form, and an aspect ratio of 1.0) | 0.82 as Ag |
| Gelatin | 1.00 |
| S-12 | $5.0 \times 10^{-4}$ |
| S-19 | $2.0 \times 10^{-4}$ |
| S-28 | $3.0 \times 10^{-5}$ |
| ExM-1 | $3.0 \times 10^{-2}$ |
| ExM-2 | 0.25 |
| ExM-3 | $1.5 \times 10^{-2}$ |
| ExY-1 | $4.0 \times 10^{-2}$ |
| Cpd-11 | $9.0 \times 10^{-3}$ |
| Solv-1 | 0.20 |
| Ninth Layer (fast green-sensitive layer) | |
| Silver iodobromide emulsion (comprising grains having an average iodide content of 8 mole %, a high iodide content in the inner part, a sphere corresponding diameter of 0.72 μm, a variation coefficient of 30% with respect to the diameter distribution, a twinned crystal form, and an aspect ratio of 1.5) | 0.55 as Ag |
| Gelatin | 0.90 |
| S-12 | $2.0 \times 10^{-4}$ |
| S-19 | $2.0 \times 10^{-4}$ |
| S-27 | $2.0 \times 10^{-5}$ |
| S-21 | $3.0 \times 10^{-4}$ |
| ExM-1 | $1.0 \times 10^{-2}$ |
| ExM-4 | $3.9 \times 10^{-2}$ |
| ExM-5 | $2.6 \times 10^{-2}$ |
| Cpd-2 | $1.0 \times 10^{-2}$ |
| Cpd-9 | $2.0 \times 10^{-4}$ |
| Cpd-10 | $2.0 \times 10^{-4}$ |
| Solv-1 | 0.20 |
| Solv-2 | $5.0 \times 10^{-2}$ |
| Tenth Layer (yellow filter layer) | |
| Gelatin | 0.90 |
| Yellow colloidal silver | $5.0 \times 10^{-2}$ as Ag |
| Cpd-1 | 0.20 |
| Solv-1 | 0.15 |
| Eleventh Layer (slow blue-sensitive layer) | |
| Emulsion No. 1 prepared in Example 1 | 0.45 as Ag |
| Gelatin | 1. 00 |
| ExY-1 | $9.0 \times 10^{-2}$ |
| ExY-3 | 0.90 |
| Cpd-2 | $1.0 \times 10^{-2}$ |
| Solv-1 | 0.30 |
| Twelfth Layer (fast blue-sensitive layer) | |

-continued

| | |
|---|---|
| Silver iodobromide emulsion (comprising grains having an average iodide content of 8 mole %, a high iodide content in the inner part, a sphere corresponding diameter of 1.4 μm, a variation coefficient of 25% with respect to the diameter distribution, a regular-twin mixed crystal form, and an aspect ratio of 1.5) | 0.60 as Ag |
| Gelatin | 0.60 |
| S-3 | $1.0 \times 10^{-4}$ |
| ExY-3 | 0.12 |
| Cpd-2 | $1.0 \times 10^{-3}$ |
| Solv-1 | $4.0 \times 10^{-2}$ |
| Thirteenth Layer (first protective layer) | |
| Fine-grain silver iodobromide (having an average grain size of 0.07 μm and an iodide content of 1 mol %) | 0.20 as Ag |
| Gelatin | 0.80 |
| UV-2 | 0.10 |
| UV-3 | 0.10 |

-continued

| | |
|---|---|
| UV-4 | 0.20 |
| Solv-3 | $4.0 \times 10^{-2}$ |
| P-2 | $9.0 \times 10^{-2}$ |
| Fourteenth Layer (second protective layer) | |
| Gelatin | 0.90 |
| B-1 (diameter: 1.5 μm) | 0.10 |
| B-2 (diameter: 1.5 μm) | 0.10 |
| B-3 | $2.0 \times 10^{-2}$ |
| H-1 | 0.40 |

In order to improve storage properties, processability, stress resistance, antimold and antibacterial properties, the antistatic properties and the coating facility, the following additives, Cpd-3, Cpd-5, Cpd-6, Cpd-7, Cpd-8, P-1, W-1, W-2 and W-3 were further added.

In addition to the foregoing additives, n-butyl-p-hydroxybenzoate was added. Moreover, B-4, F-1, F-4, F-5, F-6, F-7, F-8, F-9, F-10, F-11, an iron salt, a lead salt, a gold salt, a platinum salt, an iridium salt and rhodium salt were incorporated.

The chemical structures or chemical names of the compounds used herein are shown below.

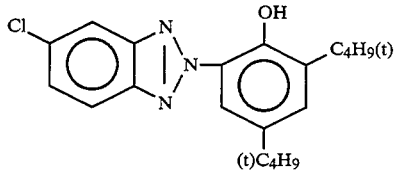

UV-1

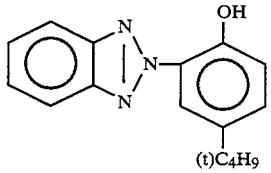

UV-2

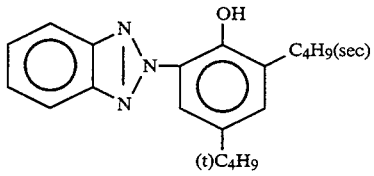

UV-3

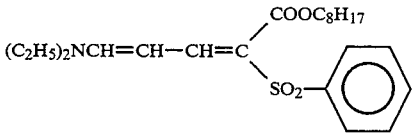

UV-4

Tricresyl phosphate — Solv-1

Dibutyl phthalate — Solv-2

Tri(2-ethylhexyl) phosphate — Solv-3

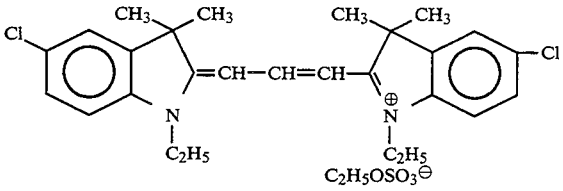

ExF-1

-continued
ExC-1
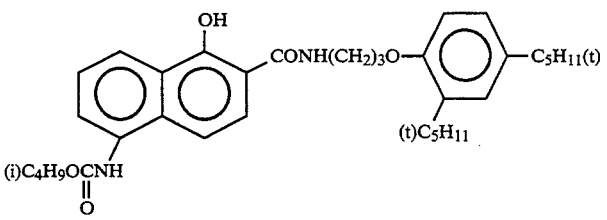
ExC-2
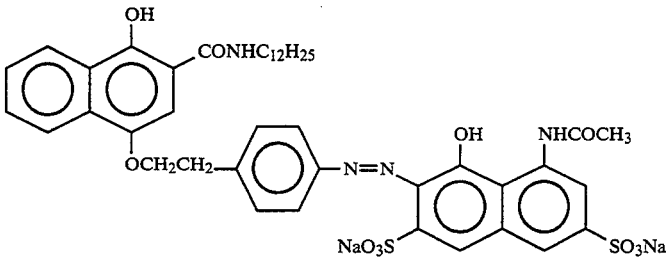
ExC-3
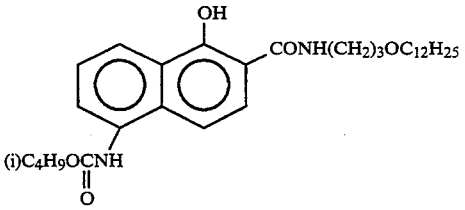
ExC-4
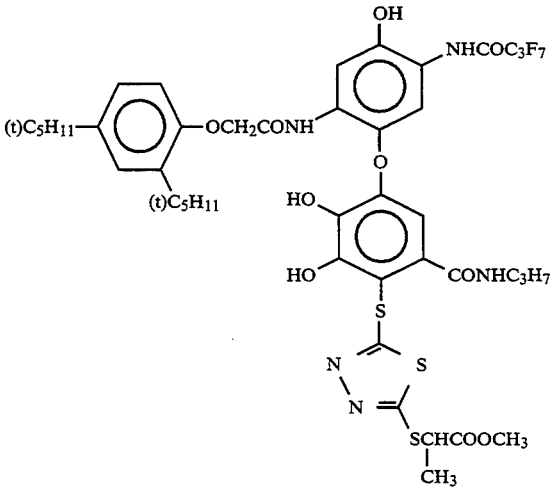
ExC-5
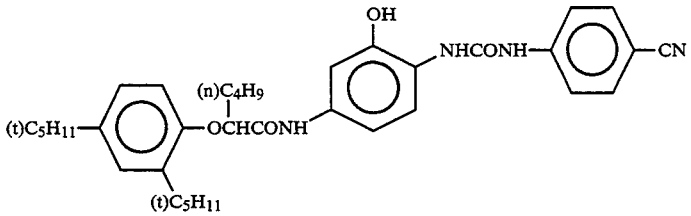
ExC-6
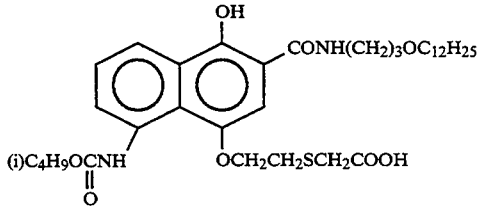

-continued
ExC-7
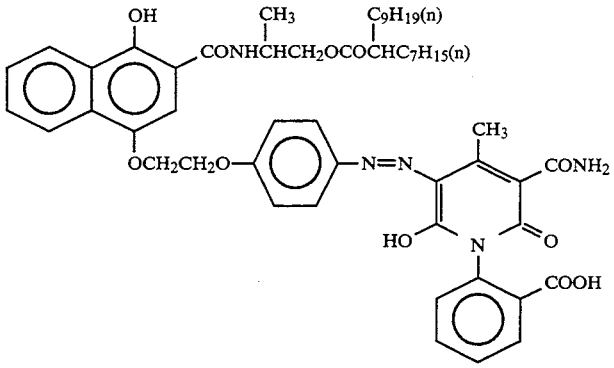
ExM-1
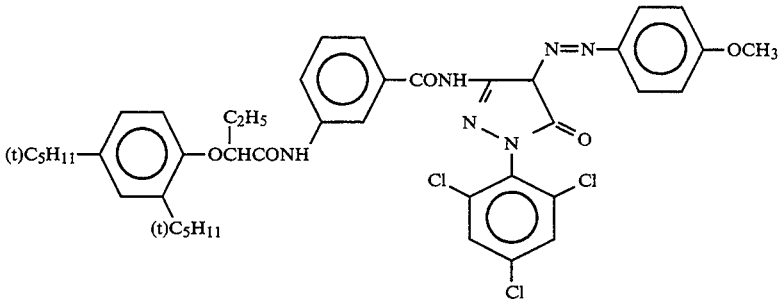
ExM-2
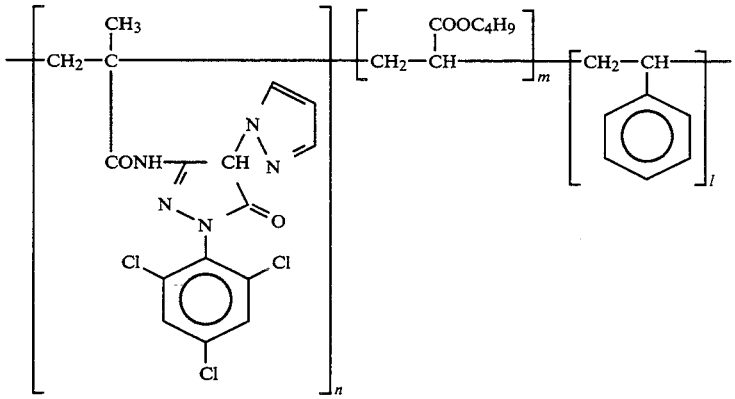
n/m/l = 50/25/25 (by weight
Average Molecular weight 20,000
ExM-3
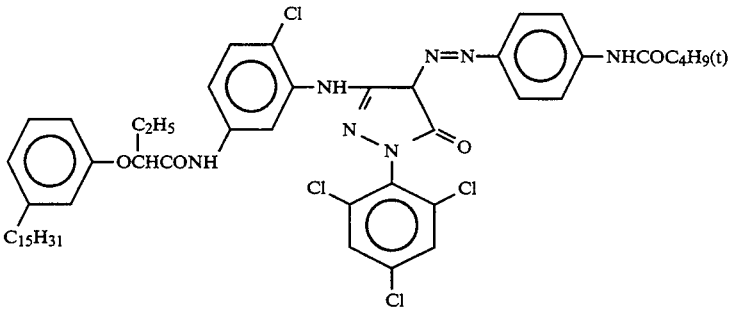

-continued
ExM-4
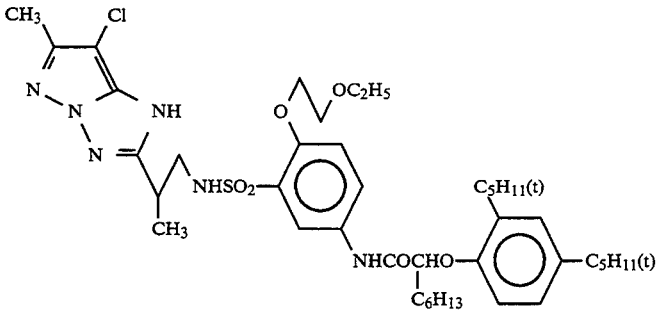
ExM-5
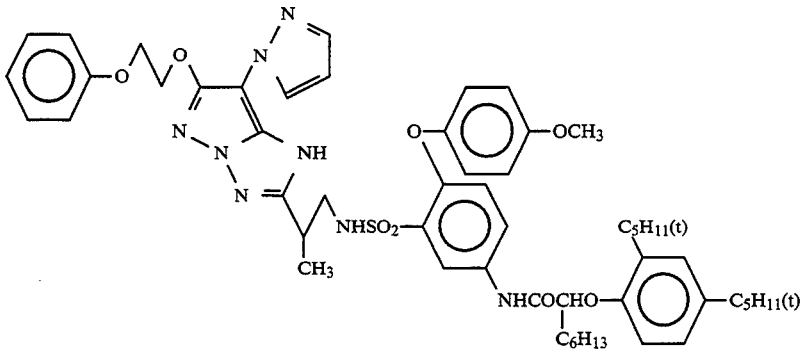
ExY-1
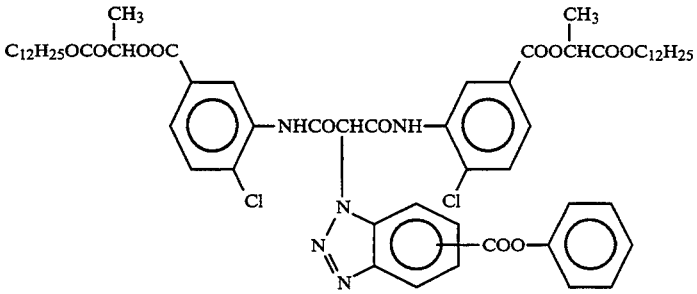
ExY-2
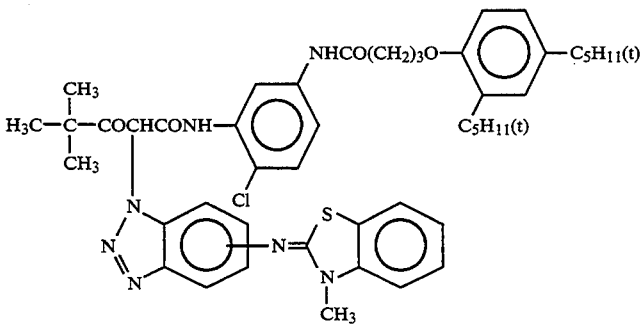
ExY-3
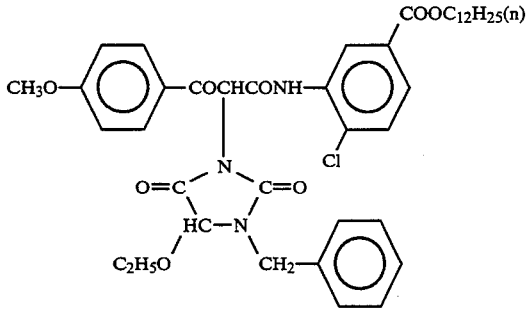

-continued
Cpd-1
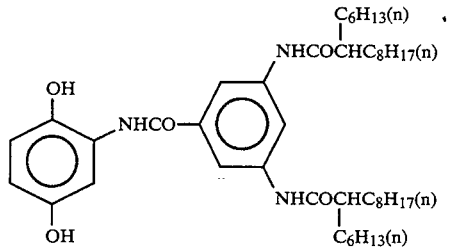
Cpd-2
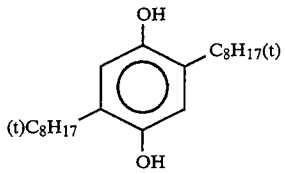
Cpd-3
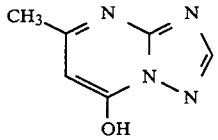
Cpd-4
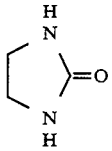
Cpd-5
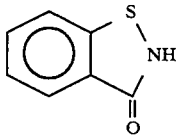
Cpd-6
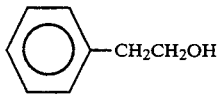
Cpd-7
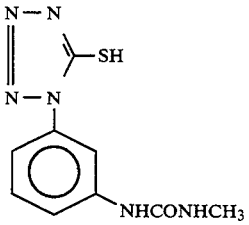
Cpd-8
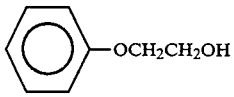
Cpd-9
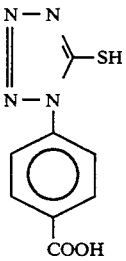

-continued
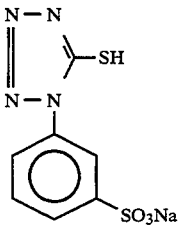
Cpd-10
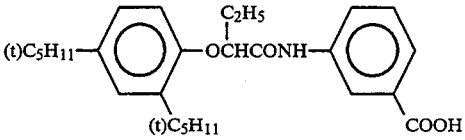
Cpd-11
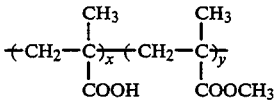
x/y = 10/90
(by mol)
B-1
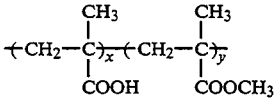
x/y = 40/60
(by mol)
B-2
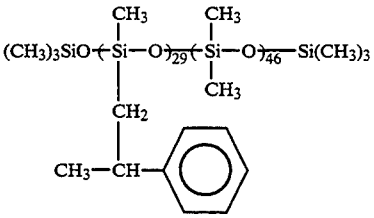
B-3
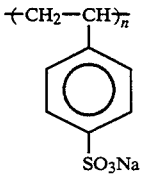
B-4
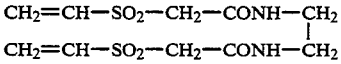
H-1
W-1
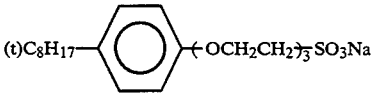
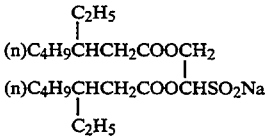
W-2
$C_8F_{17}SO_2N(C_3H_7)CH_2COOK$ W-3
Vinylpyrolidone-vinyl alcohol copolymer (ratio between comopomers = 70:30) P-1
Polyethylacrylate P-1

-continued

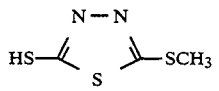
F-1

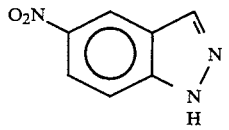
F-4

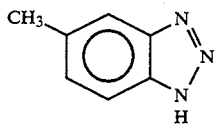
F-5

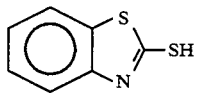
F-6

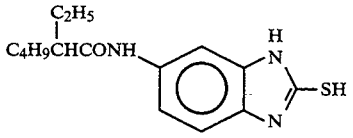
F-7

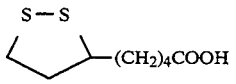
F-8

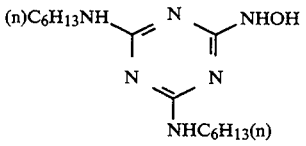
F-9

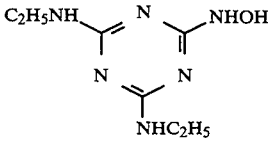
F-10

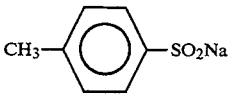
F-11

Samples 402 to 415 were prepared in the same manner as Sample 401, except that the emulsions used for forming the third, seventh and eleventh layers were changed to those set forth in Table 4 below. In addition, samples were prepared in the same manner as Samples 401 to 404, respectively, except that the coating compositions for the eleventh layers were stored at 40° C. for 12 hours prior to coating.

The thus prepared samples each were subjected to exposure (1/100 sec.) for sensitometry, and then to the following color photographic processing.

| Processing Step | Processing Time | Processing Temperature |
|---|---|---|
| Color development | 3 min. 15 sec. | 38° C. |
| Bleach | 1 min. 00 sec. | 38° C. |
| Bleach-Fixing | 3 min. 15 sec. | 38° C. |
| Washing (1) | 40 sec. | 35° C. |

-continued

| Processing Step | Processing Time | Processing Temperature |
|---|---|---|
| Washing (2) | 1 min. 00 sec. | 35° C. |
| Stabilization | 40 sec. | 38° C. |
| Drying | 1 min. 15 sec. | 55° C. |

The composition of each processing bath used is described below.

| Color Developer: | |
|---|---|
| Diethylenetriaminepenta-acetic acid | 1.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |

-continued

| | |
|---|---|
| Potassium iodide | 1.5 mg |
| Hydroxylamine sulfate | 2.4 g |
| 4-[N-ethyl-N-β-hydroxy-ethylamino]-2-methyl-aniline sulfate | 4.5 g |
| Water to make | 1.0 l |
| pH | 10.05 |
| Bleaching Bath: | |
| Ammonium ethylenediaminetetra-acetatoferrate(III) dehydrate | 120.0 g |
| Disodium ethylenediamine-tetraacetate | 10.0 g |
| Ammonium bromide | 100.0 g |
| Ammonium nitrate | 10.0 g |
| Bleach accelerator $[((CH_3)_2N—CH_2—CH_2—S)_2]$ 2HCl | 0.005 mol. |
| Aqueous ammonia (27 wt %) | 15.0 ml |
| Water to make | 1.0 l |
| pH | 6.3 |
| Bleach-fix Bath: | |
| Ammonium ethylenediaminetetra-acetatoferrate(III) dehydrate | 50.0 g |
| Disodium ethylenediamine-tetraacetate | 5.0 g |
| Sodium sulfite | 12.0 g |
| Aqueous solution of ammonium thiosulfate (70 wt %) | 240.0 ml |
| Aqueous ammonia (27 wt %) | 6.0 ml |
| Water to make | 1.0 l |
| pH | 7.2 |

Washing Water:

City water was passed through a mixed-bed column system containing H-type strong acid cation-exchange resin (Amberlite IR-120B, produced by Rhom & Haas Co.) and OH-type anion-exchange resin (Amberlite IR-400, produced by Rhom & Haas Co.), to reduce calcium and magnesium ion concentrations to 3 mg/l or less. To the thus purified water were added 20 mg/l of sodium dichloroisocyanurate and 150 mg/l of sodium sulfate. The pH of the thus obtained solution was within the range of 6.5 to 7.5.

| Stabilizing Bath: | |
|---|---|
| Formaldehyde (37 wt %) | 2.0 ml |
| Polyoxyethylene-p-monononyl phenylether (average polymerization degree: 10) | 0.3 g |
| Disodium ethylenediaminetetraacetate | 0.05 g |
| Water to make | 1.0 l |
| pH | 5.0–8.0 |

The processed samples each were evaluated for developed color densities through a red filter, a green filter or a blue filter. Based on these measurements, the sensitivities of the red-sensitive, the green-sensitive and the blue-sensitive layers were calculated relative to Sample 401 taken as 100.

An evaluation of the stress characteristics of the thus prepared samples was conducted as follows: The samples each were wound a round a columnar rod having a diameter of 6 mm o with the emulsion layers facing the inside, and maintained in that position for 10 seconds. Thereafter, the unrolled samples each were subjected to a stepwedge exposure of 1/100 seconds under the same conditions as described above, and then to the same photographic processing as" described above. The densities of the thus developed color images were measured through a blue filter, and thereby determine the sensitivities and fog densities of the blue-sensitive layers in these samples. The sensitivities are shown below relative to Sample 401 taken as 100.

Sharpness was evaluated by determining the MTF of the red-sensitive layers. The determination of MTF values was carried out in accordance with the method described in *The Theory of Photographic Process,* 3rd. ed. (published by Macmillan). Specifically, the exposure was performed using white light, and the density of the developed cyan color was measured through a red filter. The MTF value for a spatial frequency of 25 cycles/mm at a developed cyan color density of 1.3 was used for comparison as a benchmark. The greater the MTF value, the greater the sharpness of the sample.

The results obtained are shown in Table 4 and Table 5.

TABLE 4

| Sample No. | 3rd Layer Emulsion[2)] | 7th Layer Emulsion[2)] | 11th Layer Emulsion[2)] | Red-sensitive Layer Sensitivity | Red-sensitive Layer Fog | Green-sensitive Layer Sensitivity | Green-sensitive Layer Fog | Blue-sensitive Layer[3)] Sensitivity | Blue-sensitive Layer[3)] Fog | Blue-sensitive Layer (after bending) Sensitivity | Blue-sensitive Layer (after bending) Fog | MTF (red-sensitive layer) |
|---|---|---|---|---|---|---|---|---|---|---|---|---|
| 401[1)] | 3 | 2 | 1 | 100 | 0.13 | 100 | 0.18 | 100 (91) | 0.26 (0.29) | 100 | 0.34 | 0.54 |
| 402 | 6 | 5 | 4 | 105 | 0.12 | 104 | 0.17 | 104 (92) | 0.25 (0.27) | 104 | 0.32 | 0.58 |
| 403 | 9 | 8 | 7 | 106 | 0.13 | 105 | 0.18 | 104 (101) | 0.26 (0.28) | 104 | 0.30 | 0.60 |
| 404 | 12 | 11 | 10 | 108 | 0.13 | 108 | 0.18 | 105 (102) | 0.26 (0.27) | 104 | 0.30 | 0.62 |
| 405 | 15 | 14 | 13 | 108 | 0.15 | 108 | 0.19 | 106 (88) | 0.28 (0.33) | 97 | 0.34 | 0.64 |

[1)]The sample for comparison.

[2)]*The emulsions represented by the emulsion numbers used in Example 1, respectively.*

[3)]The pharenthesized values are characteristic values for the samples, the 11th layers of which were formed using the coating compositions stored at 40° C. for 12 hours after preparation, while the unpharenthesized values are those for the samples, the 11th layers of which were formed using the coating compositions stored at 40° C. for 30 minutes after preparation.

TABLE 5

| Sample No. | 3rd Layer Emulsion[2)] | 7th Layer Emulsion[2)] | 11th Layer Emulsion[2)] | Red-sensitive Layer Sensitivity | Red-sensitive Layer Fog | Green-sensitive Layer Sensitivity | Green-sensitive Layer Fog | Blue-sensitive Layer[3)] Sensitivity | Blue-sensitive Layer[3)] Fog | Blue-sensitive Layer (after bending) Sensitivity | Blue-sensitive Layer (after bending) Fog | MTF (red-sensitive layer) |
|---|---|---|---|---|---|---|---|---|---|---|---|---|
| 406[1)] | 18 | 17 | 16 | 108 | 0.14 | 109 | 0.19 | 108 (80) | 0.27 (0.37) | 92 | 0.42 | 0.65 |
| 407[1)] | 21 | 20 | 19 | 110 | 0.11 | 109 | 0.17 | 108 (75) | 0.24 (0.42) | 84 | 0.53 | 0.67 |
| 408 | 24 | 23 | 22 | 105 | 0.13 | 105 | 0.18 | 104 (100) | 0.26 (0.28) | 102 | 0.32 | 0.62 |
| 409 | 27 | 26 | 25 | 103 | 0.13 | 102 | 0.18 | 101 (90) | 0.25 (0.33) | 95 | 0.33 | 0.62 |
| 410[1)] | 30 | 29 | 28 | 96 | 0.16 | 95 | 0.21 | 92 (73) | 0.29 (0.35) | 90 | 0.33 | 0.61 |
| 411 | 33 | 32 | 31 | 115 | 0.11 | 117 | 0.15 | 116 (114) | 0.22 (0.20) | 115 | 0.25 | 0.63 |
| 412 | 36 | 35 | 34 | 112 | 0.13 | 110 | 0.16 | 113 (107) | 0.24 (0.23) | 110 | 0.28 | 0.62 |
| 413 | 39 | 38 | 37 | 110 | 0.13 | 109 | 0.17 | 109 (105) | 0.25 (0.22) | 105 | 0.30 | 0.64 |
| 414 | 42 | 41 | 40 | 120 | 0.12 | 122 | 0.16 | 123 (120) | 0.23 (0.20) | 122 | 0.25 | 0.61 |
| 415 | 45 | 44 | 43 | 114 | 0.14 | 116 | 0.18 | 112 (107) | 0.26 (0.22) | 108 | 0.30 | 0.63 |

[1)]The samples for comparison.
[2)]The emulsions represented by the emulsion numbers used in Example 1, respectively.
[3)]The pharenthesized values are characteristic values for the samples, the 11th layers of which were formed using the coating compositions stored at 40° C. for 12 hours after preparation, while the unpharenthesized values are those for the samples, the 11th layers of which were formed using the coating compositions stored at 40° C. for 30 minutes after preparation.

As clearly seen from Table 4 and Table 5, the color photographic materials of the present invention not only exhibited high color sensitivities, but also had excellent stress resistance, sharpness, and storage stability with respect to the emulsions used therein.

EXAMPLE 5

On a cellulose triacetate film support provided with a subbing layer, the layers having the compositions described below were coated in the order of description to prepare a multilayer color photographic material.

With respect to the composition of each constituent layer, the coverages of the silver halide emulsions and colloidal silver are expressed in g/m$^2$ on a silver basis, and the coverages of the couplers, additives, gelatin and sensitizing dyes are expressed in g/m$^2$. The figures on the right represent the coverage for the indicated component.

| | |
|---|---|
| First Layer (antihalation layer) | |
| Black colloidal silver | 0.37 as Ag |
| U-1 | 0.027 |
| U-2 | 0.055 |
| U-3 | 0.064 |
| HBS-3 | 0.076 |
| Gelatin | 2.81 |
| Second Layer (interlayer) | |
| U-1 | 0.027 |
| U-2 | 0.054 |
| U-3 | 0.063 |
| HBS-3 | 0.076 |
| Gelatin | 2.70 |
| Third Layer (first red-sensitive layer) | |
| Silver iodobromide emulsion 1 (comprising grains having an average iodide content of 3.0 mole %, a sphere corresponding diameter of 0.14 μm, a variation coefficient of 10.6% with respect to the diameter distribution, and an aspect ratio of 1.0) | 0.30 as Ag |
| Silver iodobromide emulsion 2 (comprising grains having an average iodide content of 3.0 mole %, a sphere corresponding diameter of 0.21 μm, a variation coefficient of 12.3% with respect to the diameter distribution, and an aspect ratio of 1.0) | 0.31 as Ag |
| S-32 | $3.80 \times 10^{-3}$ |
| C-1 | 0.25 |
| C-2 | 0.26 |
| C-3 | $7.0 \times 10^{-2}$ |
| C-10 | $3.1 \times 10^{-2}$ |
| HBS-1 | 0.11 |
| HBS-3 | 0.17 |
| Gelatin | 1.99 |
| Fourth Layer (second red-sensitive layer) | |
| Silver iodobromide emulsion 3 (comprising grains having an average iodide content of 8 mole %, a sphere corresponding diameter of 0.7 μm, a variation coefficient of 25.1% with respect to the diameter distribution, and an aspect ratio of 4.3) | 0.50 as Ag |
| Silver iodobromide emulsion 4 (comprising grains having an average iodide content of 4 mole %, a sphere corresponding diameter of 0.35 μm, a variation coefficient of 40% with respect to the diameter distribution, and an aspect ratio of 3.4) | 0.13 as Ag |
| Silver iodobromide emulsion 5 (comprising grains having an average iodide content of 2 mole %, a sphere corresponding diameter of 0.2 μm, a variation coefficient of 28% with respect to the diameter distribution, and an aspect ratio of 2.7) | 0.85 as Ag |
| S-32 | $7.70 \times 10^{-3}$ |
| C-1 | 0.20 |
| C-2 | 0.21 |
| C-3 | 0.08 |
| C-5 | 0.11 |
| C-10 | $4.6 \times 10^{-2}$ |
| HBS-1 | $8.8 \times 10^{-2}$ |
| HBS-3 | 0.14 |
| Gelatin | 2.17 |
| Fifth Layer (intermediate layer) | |

-continued

| | |
|---|---|
| Gelatin | 0.92 |
| Dye I | 0.056 |
| Dye II | 0.036 |
| U-4 | 0.023 |
| U-5 | 0.036 |
| HBS-2 | $7.7 \times 10^{-3}$ |
| Sixth Layer (first green-sensitive layer) | |
| Silver iodobromide emulsion 6 (comprising grains having an average iodide content of 3.0 mole %, a sphere corresponding diameter of 0.10 μm, a variation coefficient of 10.6% with respect to the diameter distribution, and an aspect ratio of 1.0) | 0.40 as Ag |
| Silver iodobromide emulsion 7 (comprising grains having an average iodide content of 3.0 mole %, a sphere corresponding diameter of 0.15 μm, a variation coefficient of 12.3% with respect to the diameter distribution, and an aspect ratio of 1.0) | $6.5 \times 10^{-2}$ as Ag |
| S-12 | $4.66 \times 10^{-3}$ |
| C-6 | 0.41 |
| C-7 | $7.9 \times 10^{-2}$ |
| HBS-1 | 0.40 |
| Gelatin | 1.05 |
| Seventh Layer (second green-sensitive layer) | |
| Silver iodobromide emulsion 4 (comprising grains having an average iodide content of 4 mole %, a sphere corresponding diameter of 0.35 μm, a variation coefficient of 40% with respect to the diameter distribution, and an aspect ratio of 3.4) | 0.11 as Ag |
| Silver iodobromide emulsion 5 (comprising grains having an average iodide content of 2 mole %, a sphere corresponding diameter of 0.2 μm, a variation coefficient of 28% with respect to the diameter distribution, and an aspect ratio of 2.7) | 0.50 as Ag |
| S-12 | $4.5 \times 10^{-3}$ |
| S-14 | $4.5 \times 10^{-4}$ |
| S-28 | $2.4 \times 10^{-4}$ |
| C-6 | 0.25 |
| C-8 | 0.11 |
| C-4 | $9.7 \times 10^{-2}$ |
| C-5 | $3.5 \times 10^{-2}$ |
| HBS-1 | 0.22 |
| Gelatin | 1.12 |
| Eighth Layer (third green-sensitive layer) | |
| Silver iodobromide emulsion 3 (comprising grains having an average iodide content of 8 mole %, a sphere corresponding diameter of 0.7 μm, a variation coefficient of 25.1% with respect to the diameter distribution, and an aspect ratio of 4.3) | 0.61 as Ag |
| S-12 | $1.78 \times 10^{-3}$ |
| C-6 | $4.2 \times 10^{-2}$ |
| HBS-1 | $3.7 \times 10^{-2}$ |

-continued

| | |
|---|---|
| Gelatin | 0.571 |
| Ninth Layer (yellow filter layer) | |
| Yellow colloidal silver | 0.11 as Ag |
| Cpd-12 | 0.28 |
| HBS-1 | 0.15 |
| Gelatin | 0.19 |
| Tenth Layer (first blue-sensitive layer) | |
| Silver chloroiodobromide emulsion 8 (comprising grains which have a chloride content of 15 mol %, an iodide content of 1 mole %, a sphere corresponding diameter of 0.14 μm, a variation coefficient of 9% with respect to the diameter distribution, and an aspect ratio of 1.0) | 0.53 as Ag |
| S-3 | $3.0 \times 10^{-3}$ |
| C-9 | 0.67 |
| C-11 | $3.7 \times 10^{-2}$ |
| HBS-1 | 0.26 |
| Gelatin | 0.35 |
| Eleventh Layer (second blue-sensitive layer) | |
| Silver iodobromide emulsion α | 0.53 as Ag |
| C-9 | 0.30 |
| C-4 | $9.0 \times 10^{-2}$ |
| HBS-1 | 0.10 |
| Gelatin | 1.39 |
| Twelfth Layer (first protective layer) | |
| Gelatin | 0.60 |
| U-4 | 0.10 |
| U-5 | 0.15 |
| HBS-4 | 0.033 |
| Dye III | 0.05 |
| Thirteenth Layer (second protective layer) | |
| Silver iodobromide emulsion 11 (having an iodide content of 1 mol %, a sphere corresponding diameter of 0.07 μm, a variation coefficient of 15% with respect to the diameter distribution, and an aspect ratio of 1.3) | 0.74 as Ag |
| B-5 (diameter: 1.5 μm) | $7.0 \times 10^{-2}$ |
| B-6 (diameter: 1.5 μm) | $7.0 \times 10^{-2}$ |
| Gelatin | 1.87 |
| B-7 | $2.0 \times 10^{-2}$ |
| W-7 | $2.0 \times 10^{-2}$ |
| H-2 | 0.18 |

In addition to the foregoing ingredients, 2,3-benzisothiazoline-3-one (200 ppm to gelatin on the average), n-butyl-p-hydroxybenzoate (about 1,000 ppm to gelatin), and 2-phenoxyethanol (about 10,000 ppm to gelatin) were added to the thus prepared sample. Moreover, B-8, B-9, F-12, F-13, F-14, F-15, F-16, F-17, F-18, F-19, F-20, F-21, F-22, F-23, F-24, an iron salt, a lead salt, a gold salt, a platinum salt, an iridium salt and rhodium salt were incorporated.

In each constituent layer, surfactants W-4, W-5 and W-6 were further added as coating aids or emulsifying dispersants.

The structural formulae or the chemical names of the compounds used herein are shown below.

Ultraviolet Absorbent

U-1

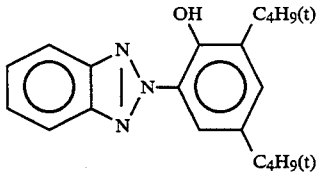

U-2

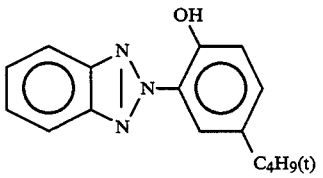

-continued
U-3
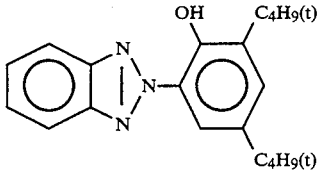
U-4
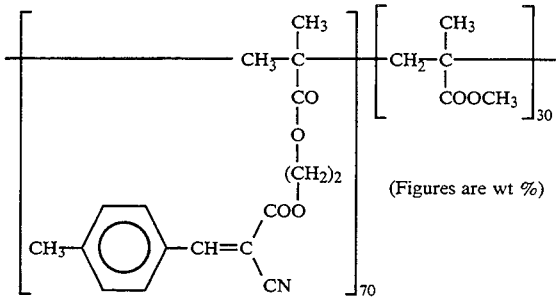
(Figures are wt %)
U-4
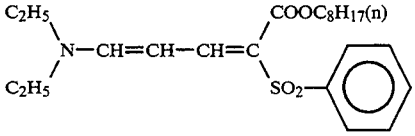
Dye I
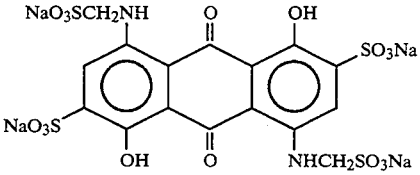
Dye II
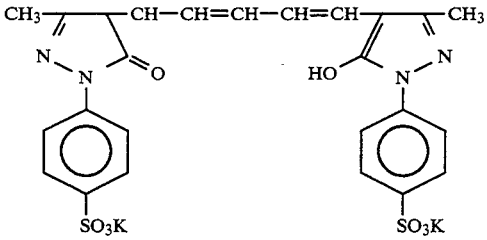
DyeIII
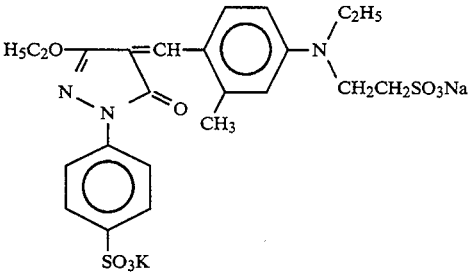
Couplers
C-1
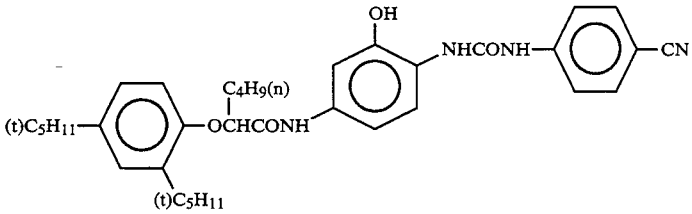
C-2
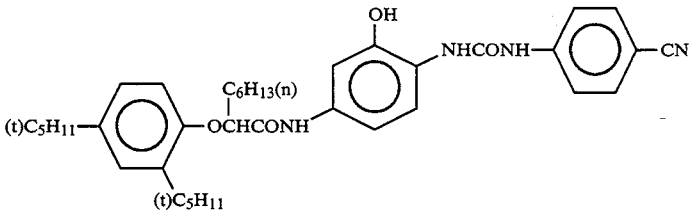
C-3
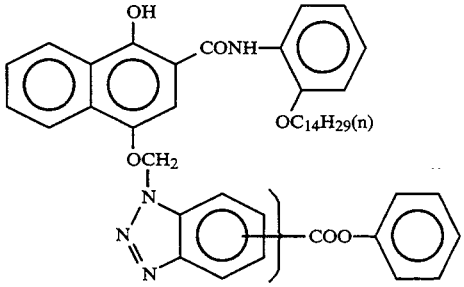

-continued
C-4
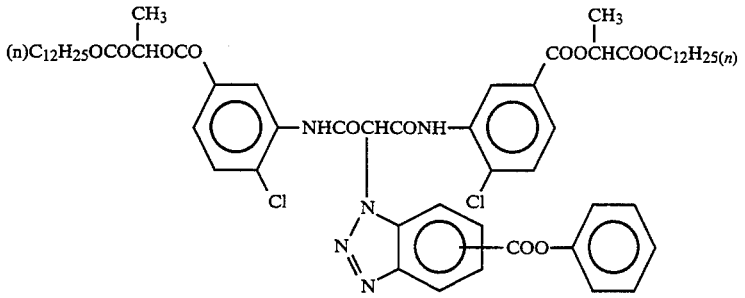
C-5
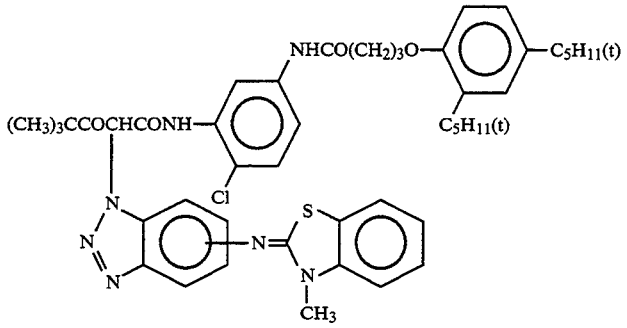
C-6
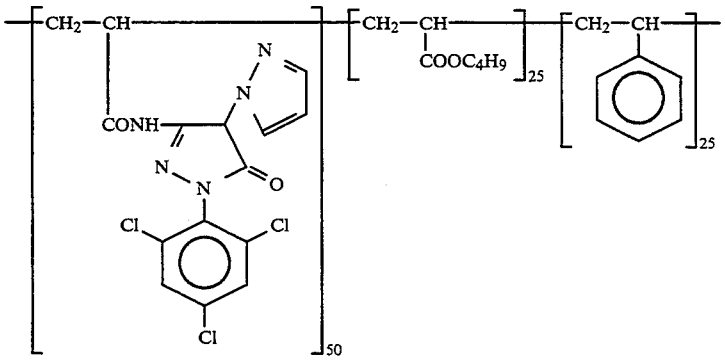
Average Molecular weight: 30,000
C-7
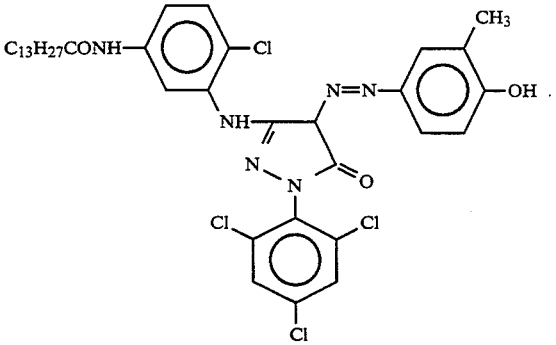

-continued
C-8
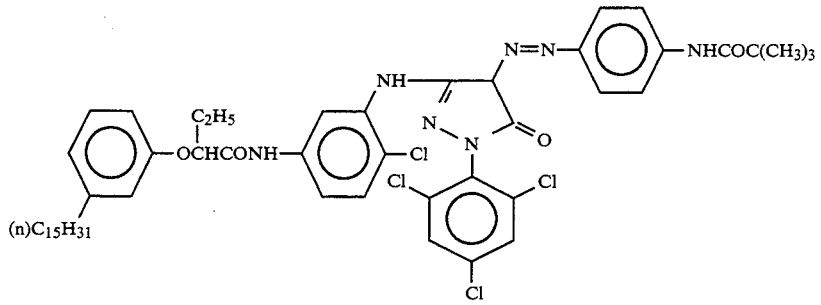
C-9
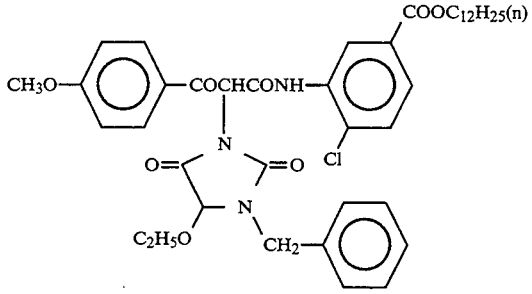
C-10
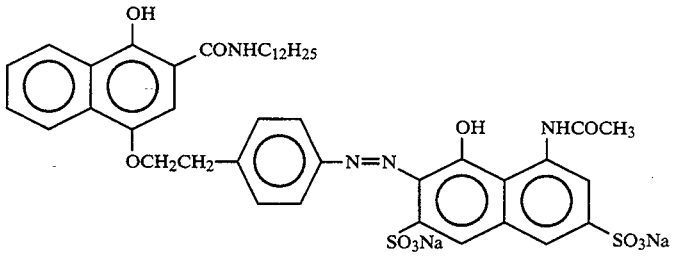
C-11
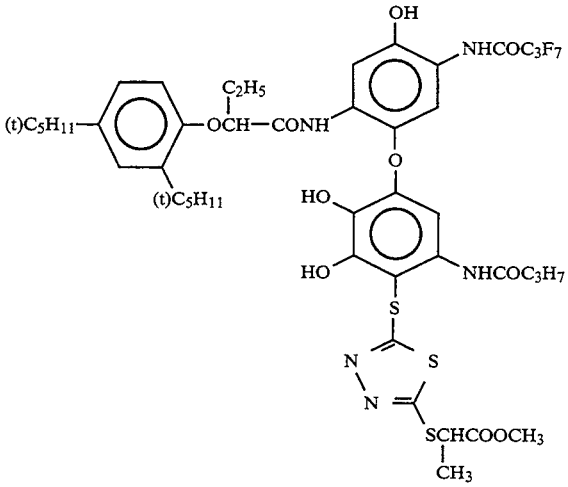
Stain Inhibitor
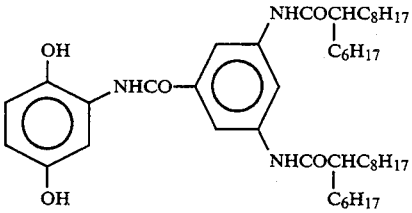
Cpd-12
Hardener
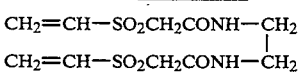
H-2
High Boiling Organic Solvents
Tricresyl phosphate HBS-1 Bis(2-ethyloxyl)phthalate HBS-2

-continued
Dibutyl phthalate HBS-3
Tri(2-ethloxyl)phosphate HBS-4
W-4
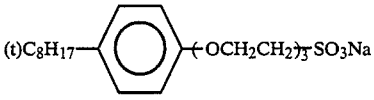
W-5
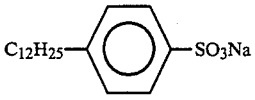
W-6
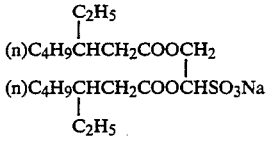
W-7
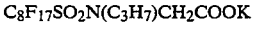
F-12
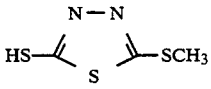
F-13
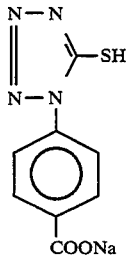
F-14
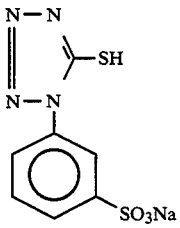
F-15
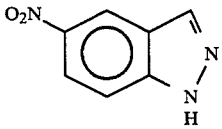
F-16
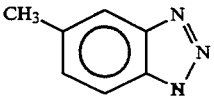
F-17
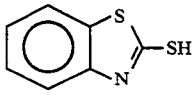
F-18
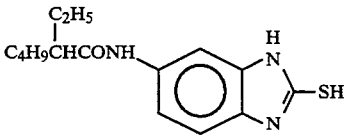
F-19
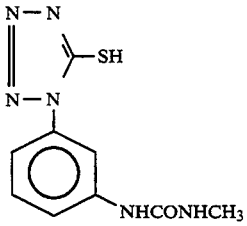
F-20
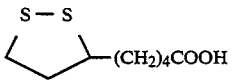
F-21
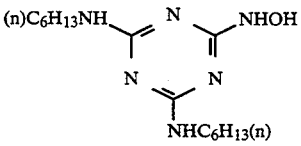
F-22
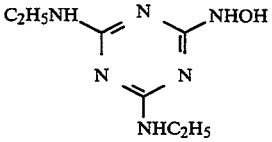
F-23
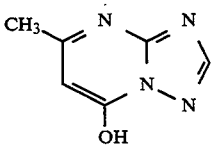
F-24
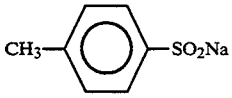
B-5
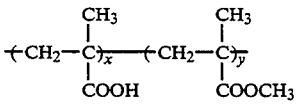
x/y = 10/90 (by mol)

-continued

B-6

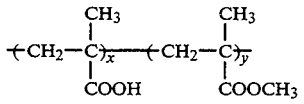

x/y = 40/60 (by mol)

B-7

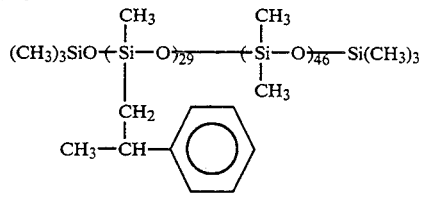

B-8

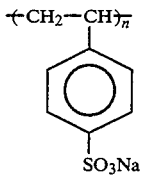

B-9

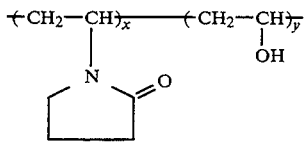

x/y = 70/30 (by mol)

Samples 501 to 515 were prepared using the emulsions set forth in Table 6, respectively, as the emulsion-α in the 11th layer of the above-described photographic material.

The thus prepared samples each were subjected to exposure for sensitometry, and then to the following color photographic processing. The exposure was conducted using a stepwedge for 10 seconds with a light source adjusted to a color temperature of 2854° K. by means of a filter.

The processed samples each were examined for developed color image densities through a yellow filter.

The sensitivity as one of photographic characteristics is expressed in terms of the reciprocal of exposure required for achieving the optical density higher than fog density by a factor of 1.1. The sensitivities set forth in Table 6 are relative to that of Sample 501 taken as 100.

The evaluation of stress characteristics and sharpness, and the determination of MTF values were made in the same manner as described in Example 4.

| Processing Step | Processing Time |
|---|---|
| Color development | 3 min. 15 sec. |
| Bleaching | 6 min. 30 sec. |
| Washing | 2 min. 10 sec. |
| Fixation | 4 min. 20 sec. |
| Washing | 3 min. 15 sec. |
| Stabilization | 1 min. 05 sec. |

The composition of each processing bath used is described below.

| | |
|---|---|
| Color Developer: | |
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-[N-ethyl-N-β-hydroxyethylamino]-2-methylaniline sulfate2 | 4.5 g |
| Water to make | 1.0 l |
| pH | 10.0 |
| Bleaching Bath: | |
| Ammonium ethylenediaminetetra acetatoferrate(III) | 100.0 g |
| Disodium ethylenediaminetetraacetate | 10.0 g |
| Ammonium bromide | 150.0 g |
| Ammonium nitrate | 10.0 g |

-continued

| | |
|---|---|
| Water to make | 1.0 l |
| pH | 6.0 |
| Fixing Bath: | |
| Disodium ethylenediaminetetraacetate | 1.0 g |
| Sodium sulfite | 4.0 g |
| Aqueous solution of ammonium thiosulfate (70 wt %) | 175.0 ml |
| Sodium hydrogen sulfite | 4.6 g |
| Water to make | 1.0 l |
| pH | 6.6 |
| Stabilizing Bath: | |
| Formaldehyde (40 wt %) | 2.0 ml |
| Polyoxyethylene-p-monononylphenylether (average polymerization degree: 10) | 0.3 g |
| Water to make | 1.0 g |

TABLE 6

| Sample No. | 11th Layer Emulsion[1)] | Blue-sensitive Layer Sensitivity | Blue-sensitive Layer Fog | Blue-sensitive Layer (after bending) Sensitivity | Blue-sensitive Layer (after bending) Fog | MTF (red-sensitive layer) |
|---|---|---|---|---|---|---|
| 501* | No. 1 analogue | 100 | 0.42 | 100 | 0.50 | 0.61 |
| 502 | No. 4 analogue | 104 | 0.43 | 104 | 0.51 | 0.63 |
| 503 | No. 7 analogue | 105 | 0.42 | 104 | 0.52 | 0.65 |
| 504 | No. 10 analogue | 107 | 0.43 | 105 | 0.53 | 0.69 |
| 505 | No. 13 analogue | 108 | 0.42 | 98 | 0.56 | 0.71 |
| 506* | No. 16 analogue | 108 | 0.44 | 90 | 0.62 | 0.73 |
| 507* | No. 19 analogue | 109 | 0.45 | 81 | 0.68 | 0.75 |
| 508 | No. 22 analogue | 106 | 0.43 | 102 | 0.54 | 0.69 |
| 509 | No. 25 analogue | 104 | 0.43 | 98 | 0.52 | 0.70 |
| 510* | No. 28 analogue | 94 | 0.45 | 70 | 0.53 | 0.68 |
| 511 | No. 31 analogue | 113 | 0.33 | 111 | 0.38 | 0.66 |
| 512 | No. 34 analogue | 111 | 0.41 | 109 | 0.48 | 0.69 |
| 513 | No. 37 analogue | 110 | 0.42 | 106 | 0.51 | 0.68 |
| 514 | No. 40 analogue | 121 | 0.38 | 118 | 0.43 | 0.67 |
| 515 | No. 43 | 113 | 0.41 | 110 | 0.50 | 0.69 |

TABLE 6-continued

| Sample No. | 11th Layer Emulsion[1)] | Blue-sensitive Layer: Sensitivity | Blue-sensitive Layer: Fog | Blue-sensitive Layer (after bending): Sensitivity | Blue-sensitive Layer (after bending): Fog | MTF (red-sensitive layer) |
|---|---|---|---|---|---|---|
| | analogue | | | | | |

*The samples for comparison.
[1)]The same emulsions as those specified by No. in Example 1, except adjusted to provide the optimum spectral sensitivity for a 10 seconds exposure.

As clearly seen from Table 6, the color photographic materials of the present invention exhibited both high sensitivity but also excellent stress resistance and sharpness.

EXAMPLE 6

Emulsions 31 to 38 having a uniform constitution and containing 5.5 mol % of silver iodide were prepared using a method similar to that of Example 1. Particularly, the grain diameter and the aspect ratio of the formed grains were controlled by properly selecting the amount of inert gelatin added at the first stage and the pAg at the time of the second-stage addition. As for the spectral sensitizing dye, Compound III used in Example 1 for imparting blue-sensitivity was added during the period between the conclusion of the grain formation and the desalting operation.

Chemical sensitization of each emulsion was performed at 64° C. using chloroauric acid and sodium thiosulfate, to maximize the spectral sensitization sensitivity for a 10 second exposure.

The thus prepared emulsions 31 to 38 are described in Table 7 below.

TABLE 7

| Emulsion No. | Average Aspect Ratio | Average Grain diameter (μm) | Average Grain Thickness (μm) | Note |
|---|---|---|---|---|
| 31 | 8.1 | 0.57 | 0.096 | Comparison |
| 32 | 4.5 | 0.40 | 0.137 | Invention |
| 33 | 8.0 | 0.76 | 0.131 | Comparison |
| 34 | 4.5 | 0.58 | 0.185 | Invention |
| 35 | 8.1 | 0.96 | 0.183 | Comparison |
| 36 | 4.6 | 0.73 | 0.244 | Comparison |
| 37 | 8.1 | 1.25 | 0.238 | Comparison |
| 38 | 4.4 | 0.91 | 0.319 | Comparison |

Samples 601 to 608 were prepared in the same manner as in Example 5, except that the emulsions set forth in Table 8 were used as the emulsion α for the 11th layer, respectively.

These samples were evaluated for sharpness of the red-sensitive layer, using the same method as described in Example 5. The results obtained are shown in Table 8.

TABLE 8

| Sample No. | No. of Emulsion used in 11th Layer | MTF (red-sensitive layer) | Sensitivity[1)] of Blue-sensitive Layer | Note |
|---|---|---|---|---|
| 601 | 31 | 0.75 | 100 | Comparison |
| 602 | 32 | 0.71 | 104 | Invention |
| 603 | 33 | 0.73 | 253 | Comparison |
| 604 | 34 | 0.67 | 268 | Invention |
| 605 | 35 | 0.70 | 540 | Comparison |
| 606 | 36 | 0.60 | 555 | Comparison |
| 607 | 37 | 0.63 | 1180 | Comparison |
| 608 | 38 | 0.52 | 1205 | Comparison |

[1)]relative values, with Sample 601 taken as 100.

As clearly seen from Table 8, by comparing the data for tabular grains having 0.30 μm of average grain diameter and the same volume but different aspect ratios, namely about 8 and about 4.5 respectively, can be compared on the various volume level, the color photographic materials comprising the tabular grains of the present invention provided a sharpness nearly equal to that of the color photographic materials comprising tabular grains having a different aspect ratio (about 8), but of the same volume.

The color photographic material prepared in accordance with the present invention is excellent in stress resistance and sharpness, as well as in sensitivity. In addition, the silver halide emulsion by which the present invention is characterized is stable upon storage prior to coating.

While the invention has been described in detail and with reference to specific examples thereof, it will be apparent to one skilled in the art that various changes and modifications can be made therein without departing from the spirit and scope thereof.

What is claimed is:

1. A silver halide color photographic material comprising a support having thereon at least one light-sensitive silver halide emulsion layer comprising a chemically sensitized silver halide emulsion containing tabular silver iodobromide grains having a silver iodide content of 5 mol % or more, an average diameter of from 0.15 to 0.5 μm and an average aspect ratio of from 3.0 to 4.8, said tabular silver halide emulsion is prepared by:

reacting a water-soluble silver salt and a water-soluble alkali halide in an aqueous reaction system containing gelatin to form a tabular silver halide emulsion containing tabular silver halide grains;

desalting; and subjecting the desalted emulsion to chemical sensitization in the presence of at least one spectral sensitizing dye.

2. A silver halide color photographic material as in claim 1, wherein the average aspect ratio is from 4.0to4.6.

3. A silver halide color photographic material as in claim 1, wherein the average diameter is from 0.2 to 0.4 μm.

4. A silver halide color photographic material as in claim 1, wherein the desalted emulsion is subjected to chemical sensitization in the presence of at least one spectral sensitizing dye and a compound represented by the formula:

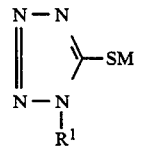

wherein $R^1$ represents an aliphatic, aromatic or heterocyclic residue substituted by at least one —COOM or —$SO_3M$ group (wherein M represents a hydrogen atom, an alkali metal atom, or a quaternary ammonium or phosphonium).

5. A silver halide color photographic material as in claim 1, wherein the tabular silver iodobromide grains have a layer structure comprising at least a core portion and a shell portion, and the silver iodide content of the core portion is greater than the silver iodide content of the shell portion.

6. A silver halide color photographic material as in claim 1, wherein the tabular silver iodobromide grains have a silver iodide content of 6 mol % or more.

7. A silver halide color photographic material comprising a support having thereon at least one light-sensitive silver halide emulsion layer comprising a chemically sensitized silver halide emulsion containing tabular silver iodobromide grains having a silver iodide content of from 5 to 10 mol %, an average diameter of from 0.15 to 0.5 μm and an average aspect ratio of from 3.0 to 4.8, said tabular silver halide emulsion is prepared by:

reacting a water-soluble silver salt and a water-soluble alkali halide in an aqueous reaction system containing gelatin to form a tabular silver halide emulsion containing tabular silver halide grains;

desalting; and subjecting the desalted emulsion to chemical sensitization in the presence of at least one spectral sensitizing dye.

8. A silver halide color photographic material comprising a support having thereon at least one light-sensitive silver halide emulsion layer comprising a chemically sensitized silver halide emulsion containing tabular silver iodobromide grains having a silver iodide content of from 5 to 17 mol %, an average diameter of from 0.15 to 0.5 μm and an average aspect ratio of from 3.0 to 4.8, said tabular silver halide emulsion is prepared by:

reacting a water-soluble silver salt and a water-soluble alkali halide in an aqueous reaction system containing gelatin to form a tabular silver halide emulsion containing tabular silver halide grains;

desalting; and subjecting the desalted emulsion to chemical sensitization in the presence of at least one spectral sensitizing dye.

* * * * *